US009855180B2

(12) United States Patent
Viscomi et al.

(10) Patent No.: US 9,855,180 B2
(45) Date of Patent: Jan. 2, 2018

(54) MASSAGE MACHINE HAVING A TILTABLE BED PROVIDED WITH A SEAT

(71) Applicant: BIOS PROJECT SRL, Rome (IT)

(72) Inventors: Alessandro Viscomi, Rome (IT); Daniele Viscomi, Rome (IT)

(73) Assignee: BIOS PROJECT SRL, Rome (IT)

( * ) Notice: Subject to any disclaimer, the term of this patent is extended or adjusted under 35 U.S.C. 154(b) by 394 days.

(21) Appl. No.: 14/647,341

(22) PCT Filed: Nov. 26, 2013

(86) PCT No.: PCT/EP2013/074659

§ 371 (c)(1),
(2) Date: May 26, 2015

(87) PCT Pub. No.: WO2014/082977

PCT Pub. Date: Jun. 5, 2014

(65) Prior Publication Data

US 2015/0320635 A1 Nov. 12, 2015

(30) Foreign Application Priority Data

Nov. 27, 2012 (IT) ..... RM2012A0596

(51) Int. Cl.

| | |
|---|---|
| ***A61H 7/00*** | (2006.01) |
| ***A61H 19/00*** | (2006.01) |
| ***A61H 15/00*** | (2006.01) |
| ***A61H 1/00*** | (2006.01) |
| ***A61H 1/02*** | (2006.01) |

(52) U.S. Cl.
CPC ..... *A61H 1/003* (2013.01); *A61H 1/0292* (2013.01); *A61H 15/0078* (2013.01);
(Continued)

(58) Field of Classification Search
CPC ..... A61H 1/001; A61H 1/003; A61H 1/005; A61H 1/006; A61H 1/008; A61H 1/02;
(Continued)

(56) References Cited

U.S. PATENT DOCUMENTS 1,456,030 A * 5/1923 Molby ..... A61H 1/0218 128/870
2,660,999 A 12/1953 Thornton
(Continued)

FOREIGN PATENT DOCUMENTS

DE 2929276 A1 2/1981
DE 3421872 A 12/1985
(Continued)

OTHER PUBLICATIONS

International Search Report, dated Feb. 24, 2014, from corresponding PCT application.

*Primary Examiner* — Joshua Lee
(74) *Attorney, Agent, or Firm* — Young & Thompson

(57) ABSTRACT

A massage machine has a base (1) and a bed (6) with a first longitudinal axis frame transversally swinging mounted on the base (1) and sustaining a patient support plane (7) having a head crossbar and a foot crossbar (17, 11) being mutually connected by telescopic side members (18) and ball joints (19). A second frame being mounted under the patient support plane (7) and has pairs of lower and upper oscillating end cross members (59, 60 and 59-A, 60-A) being joined together by pairs of lower and upper telescopic longitudinal members (62, 63) and ball joints (19-B) and supports a longitudinally movable massage apparatus having massaging roller systems (27) and massaging planetary systems (28) arranged on supporting frames (45, 45-A) movable in turn on lower telescopic longitudinal members (62), and patient supporting elements with idle transversal rollers (29, 30) sliding on upper telescopic longitudinal members (63).

9 Claims, 28 Drawing Sheets

(52) U.S. Cl.
CPC ..... *A61H 2001/0203* (2013.01); *A61H 2015/0021* (2013.01); *A61H 2015/0028* (2013.01); *A61H 2015/0035* (2013.01); *A61H 2201/0142* (2013.01); *A61H 2201/0149* (2013.01); *A61H 2201/1604* (2013.01); *A61H 2201/1616* (2013.01); *A61H 2201/1623* (2013.01); *A61H 2201/1633* (2013.01); *A61H 2201/1642* (2013.01); *A61H 2201/1654* (2013.01); *A61H 2201/1664* (2013.01); *A61H 2201/1669* (2013.01); *A61H 2201/1671* (2013.01); *A61H 2203/045* (2013.01); *A61H 2203/0493* (2013.01); *A61H 2205/081* (2013.01)

(58) Field of Classification Search
CPC ..... A61H 1/0292; A61H 2001/0203; A61H 2001/0207; A61H 2001/0211; A61H 15/0078; A61H 2015/0021; A61H 2015/0028; A61H 2015/0035; A61H 2201/0142; A61H 2201/0149; A61H 2201/1604; A61H 2201/1616; A61H 2201/1623; A61H 2201/1633; A61H 2201/1642; A61H 2201/1654; A61H 2201/1664; A61H 2201/1669; A61H 2201/1671; A61H 2203/045; A61H 2203/0493; A61H 2205/081
See application file for complete search history.

(56) References Cited

U.S. PATENT DOCUMENTS

| | | | | |
|---|---|---|---|---|
| 2,950,715 | A | 8/1960 | Brobeck | |
| 3,060,925 | A | 10/1962 | Honsaker et al. | |
| 3,420,229 | A | 1/1969 | Miller | |
| 3,898,985 | A * | 8/1975 | Butcher | A61H 11/00 601/101 |
| 4,656,998 | A | 4/1987 | Masuda et al. | |
| 4,672,697 | A | 6/1987 | Schurch | |
| 5,088,475 | A | 2/1992 | Steffensmeier | |
| 5,876,358 | A | 3/1999 | Goebel | |
| 6,190,338 | B1 | 2/2001 | Arndt | |
| 6,243,897 | B1 | 6/2001 | Sumiya | |
| 6,277,141 | B1 | 8/2001 | Lake | |
| 6,319,213 | B1 | 11/2001 | Tomac | |
| 6,971,997 | B1 | 12/2005 | Ryan et al. | |
| 7,118,542 | B2 | 10/2006 | Palazzolo et al. | |
| 2005/0020946 | A1 * | 1/2005 | Kim | A61H 7/004 601/15 |
| 2007/0293796 | A1 * | 12/2007 | Graham | A61F 5/3784 602/19 |
| 2009/0077748 | A1 * | 3/2009 | Kim | A47C 19/04 5/613 |
| 2011/0082399 | A1 * | 4/2011 | Yeh | A61H 1/005 601/52 |
| 2011/0270142 | A1 | 11/2011 | Yang | |

FOREIGN PATENT DOCUMENTS

| | | | |
|---|---|---|---|
| EP | 0721319 | A | 11/2001 |
| EP | 1334708 | A | 8/2003 |
| FI | 962893 | A | 7/1996 |
| GB | 2077106 | A | 12/1981 |
| GB | 2152381 | A | 8/1986 |
| JP | 58143775 | A | 8/1983 |
| JP | 7000468 | A | 1/2007 |
| WO | 8404452 | A | 11/1984 |
| WO | 2006027277 | A | 3/2006 |
| WO | 2008133066 | A1 | 11/2008 |

* cited by examiner fig. 28
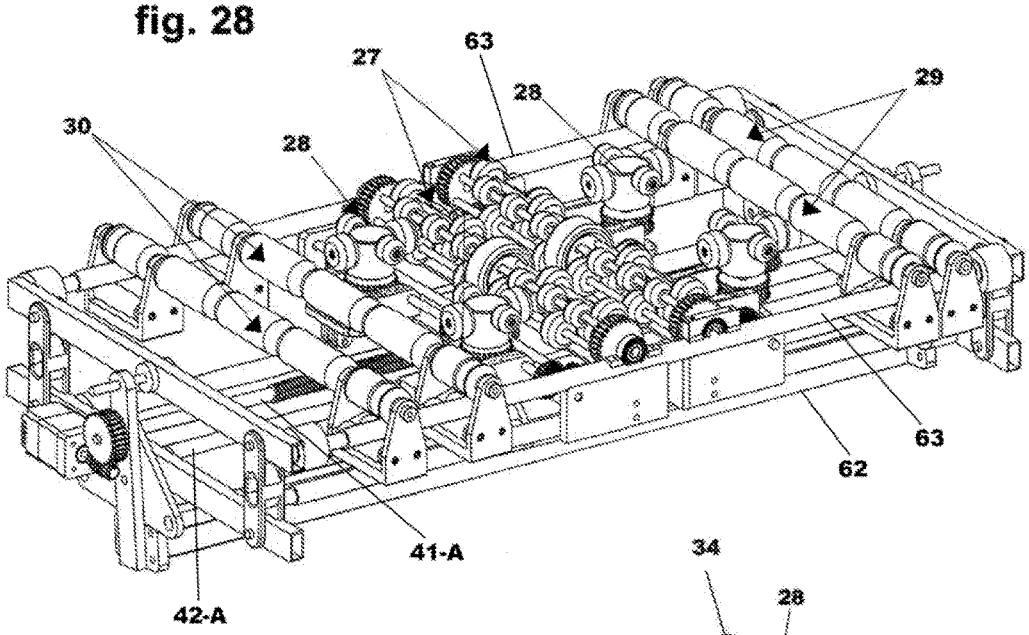
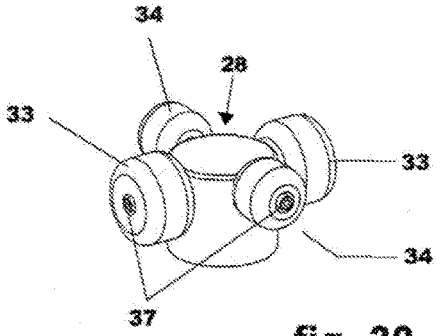
fig. 30
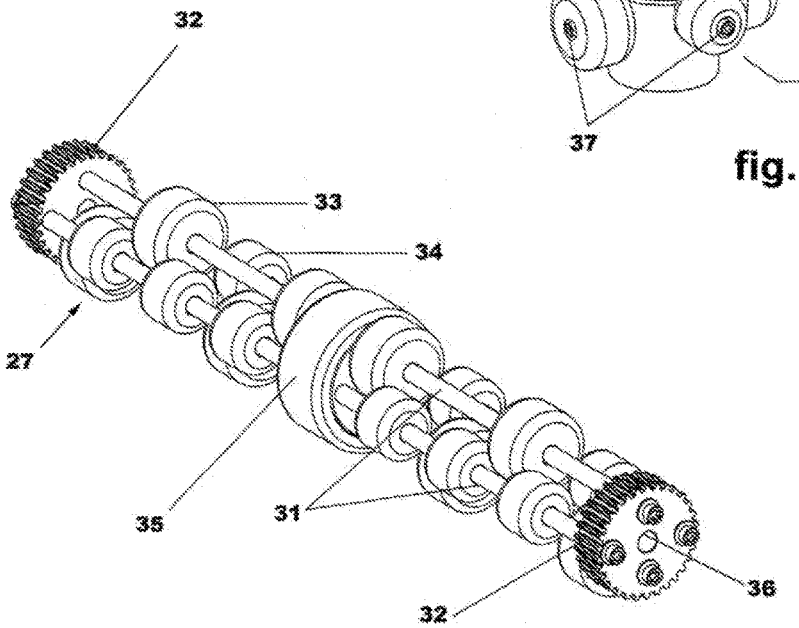
fig. 29 fig. 41
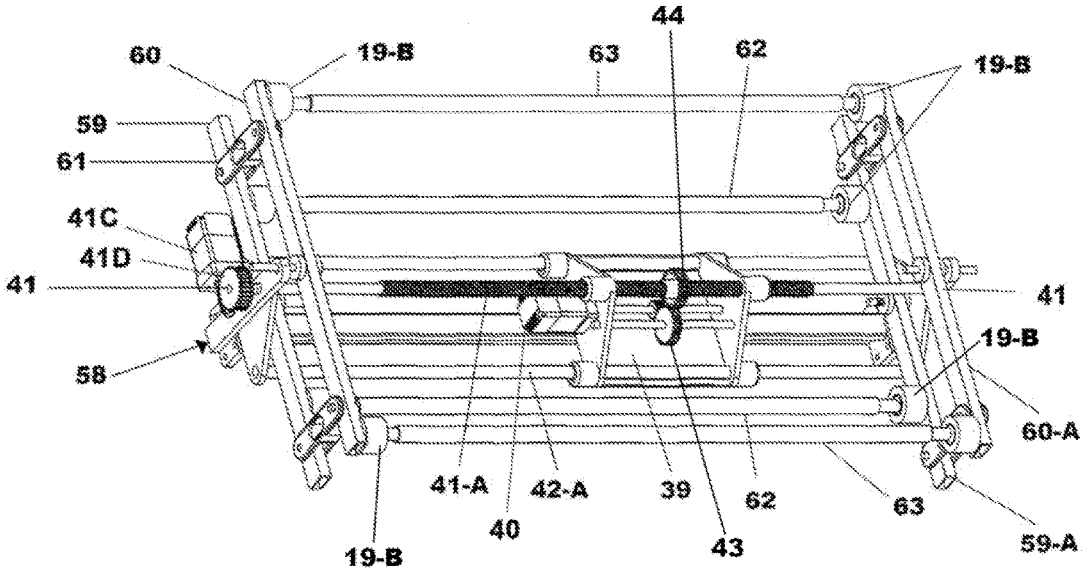
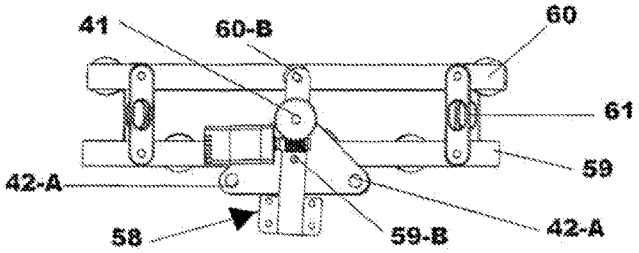
fig. 42

MASSAGE MACHINE HAVING A TILTABLE BED PROVIDED WITH A SEAT

The present invention relates to a massage machine having a tiltable bed provided with a seat.

There are already many prior art documents that describe tiltable beds for therapeutic treatments. They are pivoted in their middle to swing and lock in desired positions. See for example U.S. Pat. No. 4,672,697, DE 3,421,872, FI 962 893, GB 2,152,381, U.S. Pat. No. 3,060,925, WO8404452, DE 2929276 and EP 1334708.

In particular, U.S. Pat. No. 6,243,897 describes an automatic therapeutic bed for inversely suspending/standing a patient at various angles; a part of the bed is transformed into a sitting surface. There are other patents that describe a chair that turns into a bed for massage as WO 2008/133066.

In the tiltable beds mentioned above, there are no devices for automatic massages of a patient. U.S. Pat. No. 6,319,213 describes a tiltable platform having a rear support section that is movable relative to a base section along a longitudinal axis. Other documents, such as U.S. Pat. No. 4,656,998, U.S. Pat. No. 5,876,358, U.S. Pat. No. 6,190,338, U.S. Pat. No. 7,118,542, JP 7,000,468, U.S. Pat. No. 5,088,475, EP 0 721 319, GB 2 077 106 and JP 58143775, describe massage machines having generally a fixed bed. In particular, WO2006/027277 relates to a machine equipped with a bed having a massager cart able to advance by means of a worm screw. Some of the prior art documents describe machines capable of causing a twisting of the body of the patient. U.S. Pat. No. 2,950,715 relates to a machine comprising a flexible or soft bed for the body, deflection means of the bed to twist the lower end of the body in a direction opposite to its upper end and means to stretch the body while it is subjected to torsion. For this purpose, the machine according to U.S. Pat. No. 2,950,715 is equipped with retaining means of the patient's arms and head and means for retaining the patient's waist, and a lever connected to the latter means and rockable by a motor. For purposes similar to those of U.S. Pat. No. 2,950,715, the U.S. Pat. No. 3,420,229 describes in a table for osteopathic treatment a combination of patient's traction means and patient's support means when the patient is in a lying position and spinal column torsion means for twisting the spinal column first in one direction and then in the other direction. The support means comprises a first oscillating cushion for the higher areas of the patient's torso and a second oscillating cushion for the lower zones of the patient's torso and motor means connected to the support means for swinging the cushions in opposite directions around an axis parallel to the spinal column.

The patents U.S. Pat. No. 2,950,715 and U.S. Pat. No. 3,420,229 do not describe a machine capable of massaging the patient while his/her torso is subjected to torsion.

The prior art cited above shows some drawbacks that the present invention aims to overcome.

One purpose of the present invention is to provide a massage machine that allows a patient to be massaged automatically in the shoulders also while his/her torso is subjected to a torsion.

Another object of the invention is to allow the patient to get comfortably into the bed of the massage machine.

In particular, one object of the invention is to adjust according to the needs the means for enabling the patient to get into the bed of a massage machine.

The aims specified are substantially achieved by a massage machine having a tiltable bed provided with a seat, comprising the technical features exposed in one or more of the appended claims.

Further features and advantages of the present invention will become more apparent from the indicative, and therefore non-limiting description of a preferred but not exclusive embodiment of a massage machine having a tiltable bed provided with a seat, as illustrated in the accompanying drawings in which:

FIG. 28 is a perspective view of a massage apparatus of the machine according to the invention mounted on a twistable frame;

FIG. 29 is a perspective view of a massaging roller system of the massage apparatus in FIG. 28;

FIG. 30 is a perspective view of a massaging planetary system of the massage apparatus in FIG. 28;

FIGS. 41 and 42 are a perspective view and an end view respectively, of the frame in FIG. 28;

Figure 1:
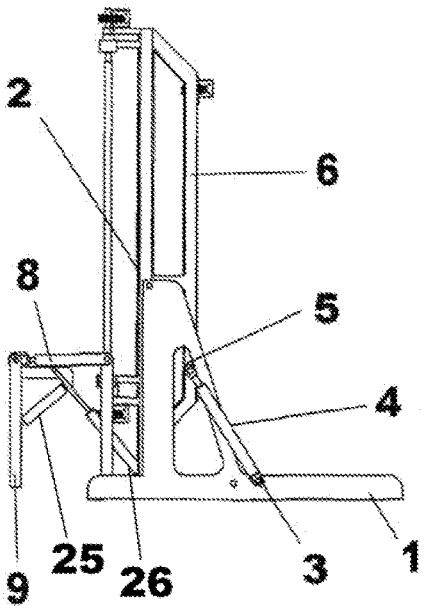
FIGS. 1 to 3 are schematic side views of a massage machine according to the invention having a bed shown in three different settings without its massage apparatus.
Figure 2:
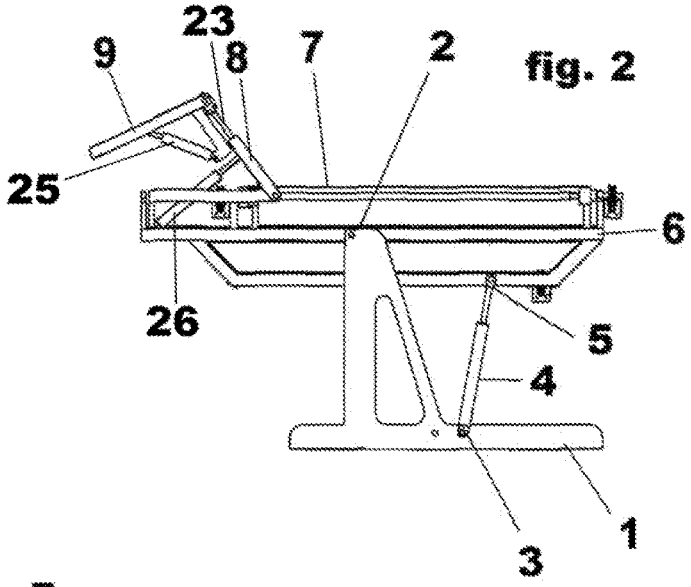
Figure 3:
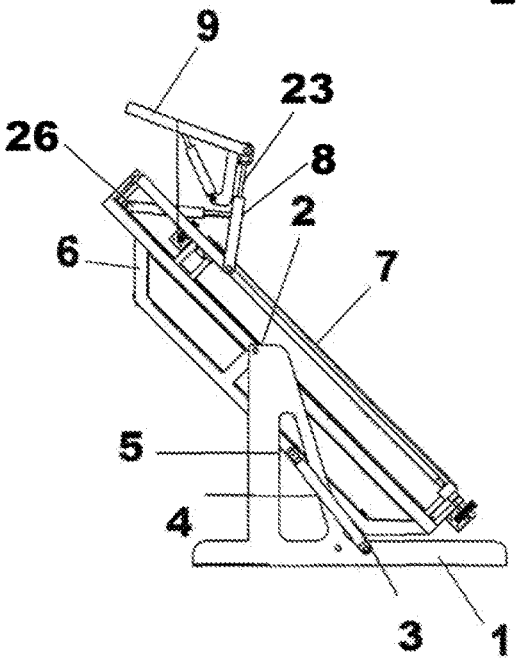

First, reference is made to FIGS. 1 to 3 which illustrate in side views three main structures of the massage machine according to the present invention. The massage machine comprises a base 1 having vertical supports provided with horizontal pivots 2 for a connection of a tiltable bed 6 being designed, in particular, to the treatment of the spinal column. The tiltable bed 6 has a first frame being mounted on the horizontal pivots 2 of the base 1, first frame that has a longitudinal axis in the head-foot direction of the bed 6. The first frame has a patient supporting plane 7 that can be arranged in various positions: a vertical position, as shown in FIG. 1, with the foot of the bed downward; a horizontal position, as shown in FIG. 2, and a 45 degrees inclined position about its transverse axis that is at right angle with said longitudinal axis and is defined by horizontal pivots 2, with the head of the bed downward, as shown in FIG. 3. Thus, the patient supporting plane can achieve and maintain any inclination in the angular range of 135 degrees. The different inclinations are determined by the hydraulic cylinders 4, positioned between a fixed transverse connecting bar 3 at the bottom of the base 1 and an adjustable transverse connecting bar 5 on the bed 6, as shown and described in the following.

In FIG. 2 the bed 6 in a horizontal position gives a great stability to the machine that is subjected to the patient's weight and to thrusts downwards probably caused by therapist's maneuvers.

In these conditions, it is evident that a complete back-tilt of the patient supporting plane is impossible as said back-tilt, even at full retraction of the piston of the cylinder 4, would be hindered by the length of the body of the cylinder itself.

In FIG. 1 the patient supporting plane of the machine has been brought in vertical position thanks to the displacement of the application point of the force on the adjustable transverse connecting bar 5 near the end of the foot of the bed 6.

The hydraulic cylinders 4 can be replaced by suitably dimensioned electric linear actuators.

Figure 55:
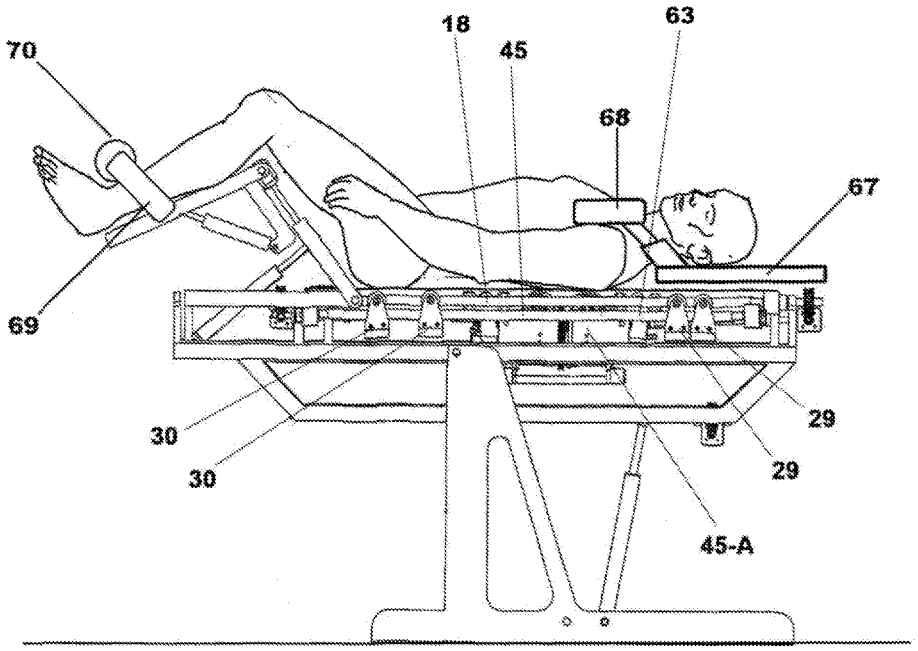
FIGS. 55 to 59 are side views of the massage machine according to the invention with a patient on the bed in various positions.
Figure 56:
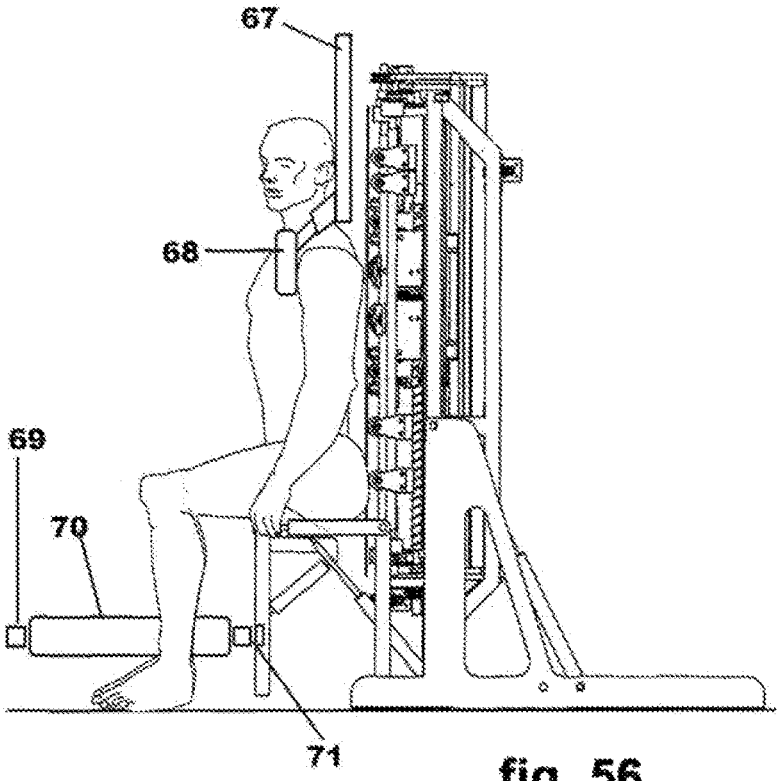

In order to access the treatment a patient sits on the sitting plane 8, as shown in FIG. 1 and, better, in the side view of FIG. 56, and then the bed 6 is positioned horizontally, as shown in FIG. 2 (see also the side view of FIG. 55). As will be seen better later on, sitting plane 8 and legs 9 are transformable by seat into leg support by varying mutual inclination of the individual elements and adapting their length to the length of the proximal section of the lower limbs.

During the treatment the bed 6 can be back-tilted (see also the side views of FIGS. 57 to 59), according to requirements, up to 45 degrees to perform a gentle traction of the spinal column. The back-tilting movement up to 45 degrees is used for the distension of the vertebral column by gravity. It should be kept in mind that the patient undergoing the treatment, in most cases, has musculo-skeletal pains, and therefore may have difficulties in accessing to the machine and in positioning therein, also due to the height of the patient support plane which may be between 85 and 90 cm.

Further, once the treatment is complete, especially if such a treatment resulted a back-tilting and torsion oscillation, almost certainly the patient has suffered changes in orthostatic pressure; therefore, the patient has to be stabilised before being brought back to the upright position. The bed 6 is returned gradually to the vertical position, with appropriate pauses in order to allow the stabilisation of the values of the orthostatic pressure of the patient, which can set on his/her feet again.

As mentioned above, the positions illustrated are not the only ones, as the bed on the massage machine according to the invention can be positioned in any point of the complete arc of rotation as expected.

Figure 4:
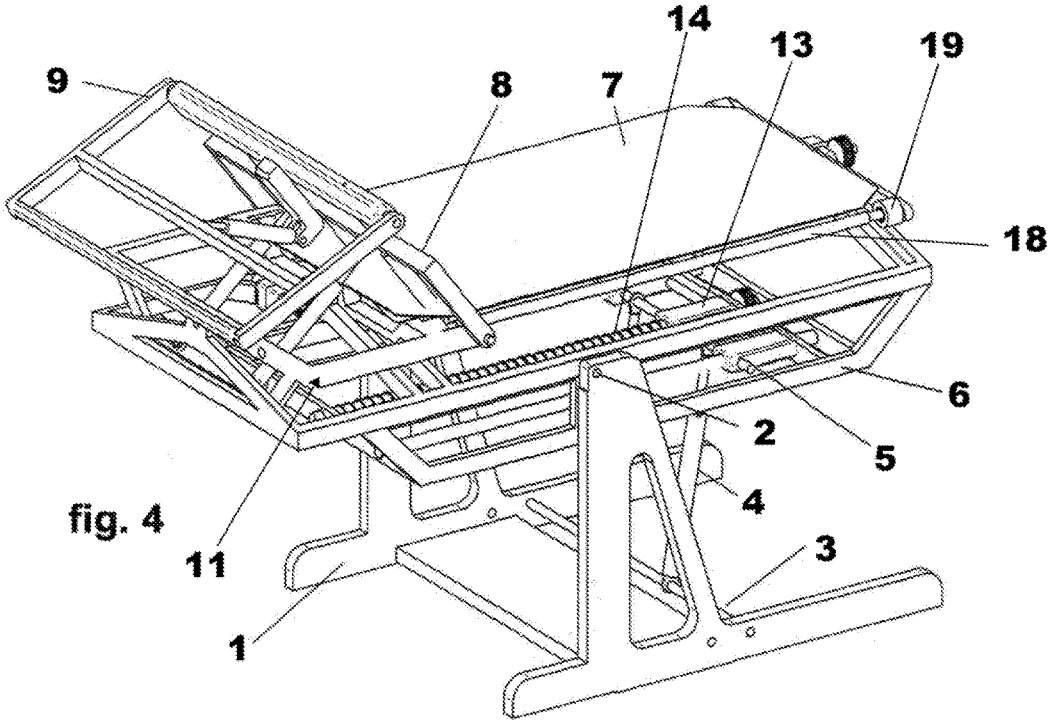
FIG. 4 is a perspective view of the machine according to the invention without the massage apparatus.

FIG. 4 is a perspective view of the massage machine in FIGS. 1 to 3. As already said and shown here in greater detail, the massage machine includes the base 1 to which the bed 6 is connected by means of the pivots 2. The base 1 includes the fixed transverse connecting bar 3 for two hydraulic cylinders 4. Below the patient supporting plane 7 there is a massage apparatus that is not represented in FIG. 4 and will be described only later.

The two hydraulic cylinders 4 are mounted between the fixed transverse connecting bar 3 of the base 1 and the adjustable transverse connecting bar 5 of the bed 6.

Figure 6:
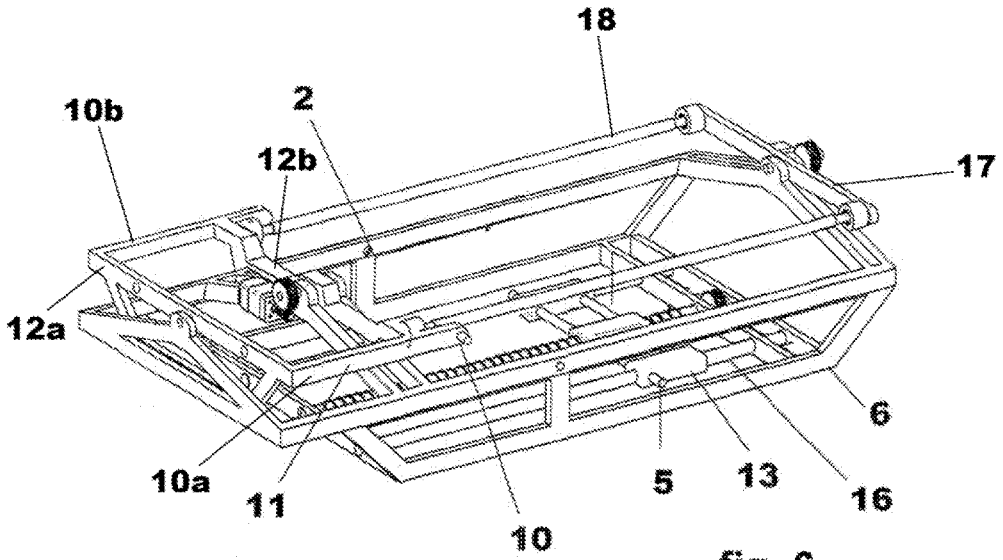
FIGS. 5 to 7 are respectively a plan view from below, an exploded perspective view and a side view of the bed according to the invention, a carriage being longitudinally slidable in the bed.
Figure 5:
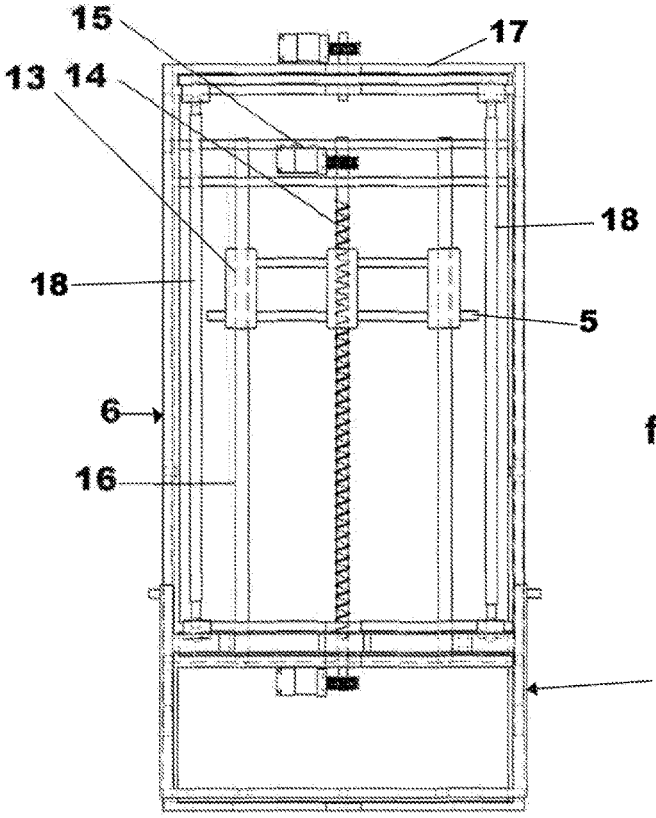
Figure 7:
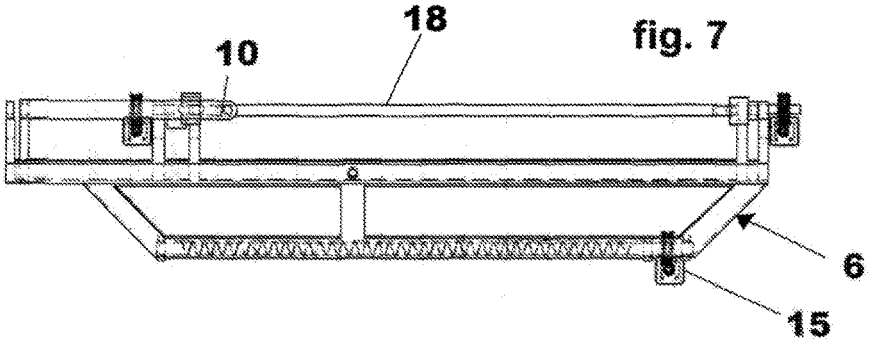

Reference is made now to FIGS. 5 to 7, in which FIG. 5 is a plan view from below of the bed 6, FIG. 6 is an exploded perspective view and FIG. 7 is a side view of the same. The adjustable transverse connecting bar 5 is part of a carriage 13 that, by sliding longitudinally along longitudinal guides 16, moves the point of application of the force on the adjustable transverse connecting bar 5, exerted by the pair of hydraulic cylinders 4, in thrust or traction in respect of the bed 6, causing it to assume various positions ranging from the vertical to the back-tilted position.

The movement of the carriage 13 is obtained by the rotation of a worm screw 14 driven by a geared motor 15.

The patient may be subjected, as will be seen below, also to rotational movements through the action of torsion of the patient supporting plane 7, torsion however not exceeding 15 degrees, for the scapular-humeral region and, in the opposite direction, for the lumbosacral region. Advantageously, the two movements can be carried out independently of one another.

Figure 10:
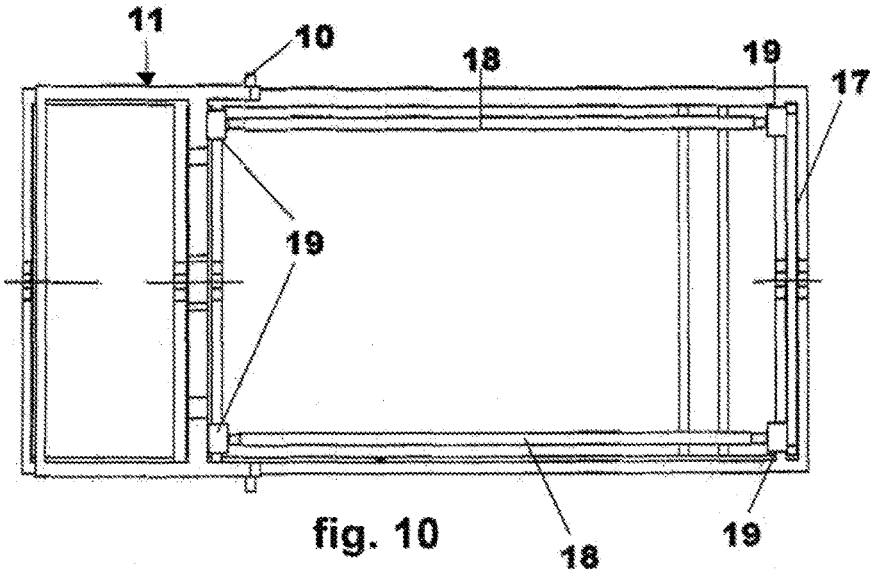
Figure 11:
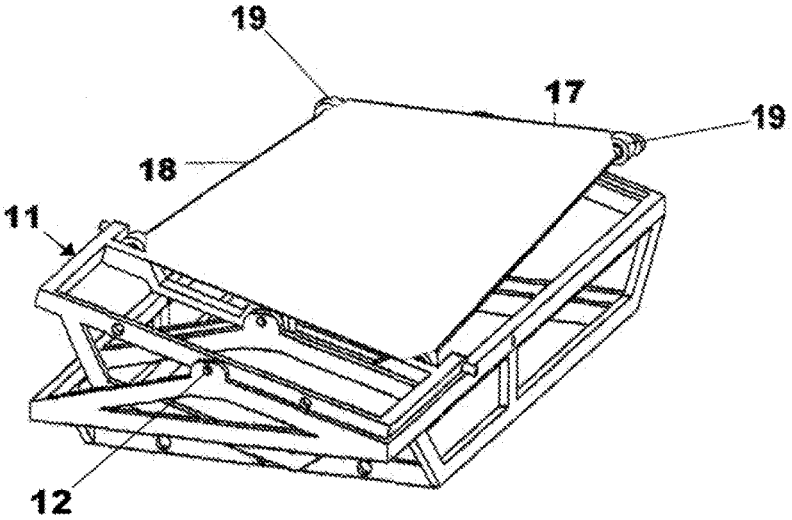
Figure 12:
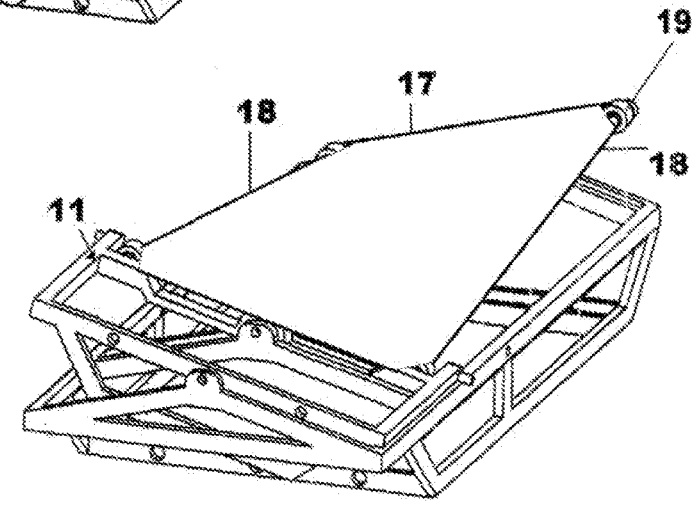
Figure 13:
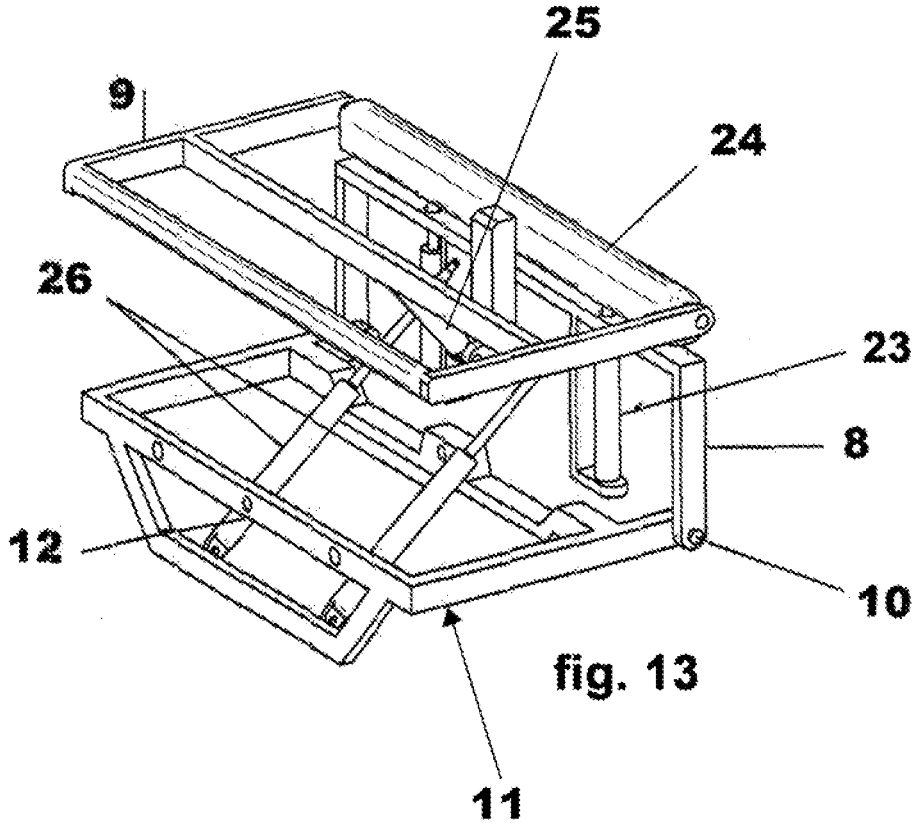
FIG. 13 is a perspective view of a seat/leg support of the machine according to the invention in a first arrangement thereof.
Figure 14:
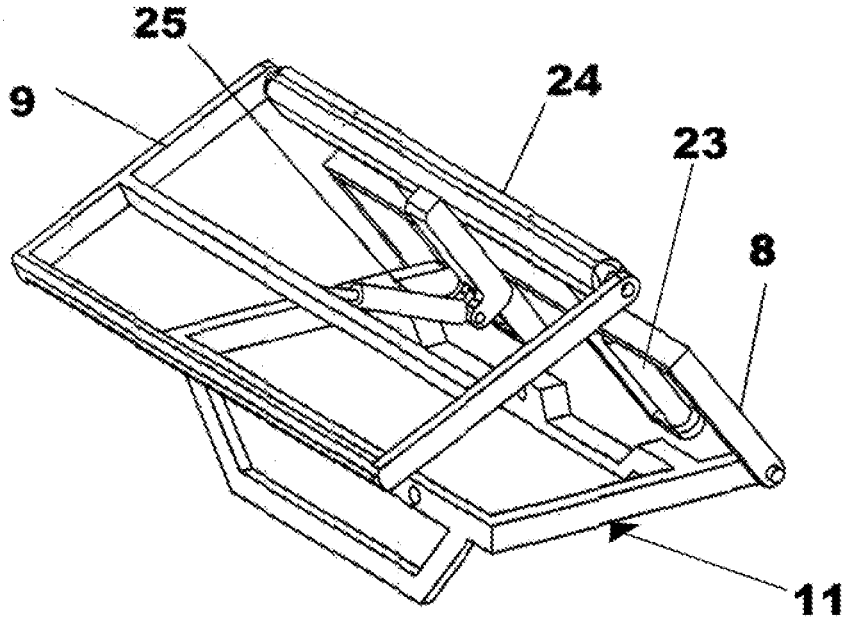
FIG. 14 is a partial perspective view of the seat/leg support in FIG. 13 in a second arrangement thereof.

Reference is made now to FIGS. 8 to 12 which are a perspective view of the bed 6 with patient supporting plane 7, a side view and a top plan view of the bed 6 and perspective views with twisted patient supporting plane 7, respectively. This patient supporting plane is made from a robust and flexible cloth that is fixed on two crossbars 11 and 17 and two longitudinal members 18, as seen in FIGS. 10 to 12. The two crossbars 11 and 17 are pivoted on the first frame of the bed 6 about a central longitudinal axis thereof, which crosses seats 12 of pivots sustaining the patient supporting plane 7. Thus, the patient supporting plane 7 can perform torsional movements about the central longitudinal axis of the first frame of the bed obtained by swinging, in one direction or another, the crossbar on the cervical side or head crossbar 17, and the crossbar on the lumbosacral side or foot crossbar 11.

Figure 15:
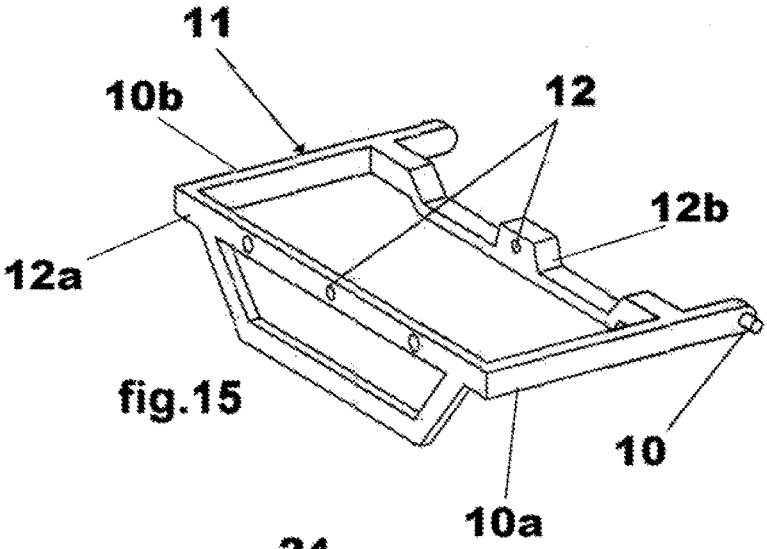
FIG. 15 is a perspective view of a first part of the seat/leg support in FIG. 13.

Indeed, as shown in FIG. 15 that is an enlarged perspective view of the crossbar 11, the latter is made of two cross members 12*a*, 12*b* that are mutually connected by side sections 10*a*, 10*b*.

The two longitudinal members 18, which are joined at their ends by the two crossbars 11, 17, form with the two crossbars 11, 17 a parallelepiped which sustains the patient supporting plane 7. The two longitudinal members 18 follow the inclination of the two crossbars 11, 17.

In the massage machine according to the invention the problem related to the articulated connection between the longitudinal members and the crossbars, as well as the problem related to the fact that the length of the longitudinal members changes with the aforesaid inclination, have been overcome.

The first problem has been solved by using four ball joints 19, and the second problem has been overcome by a telescopic coupling inside each longitudinal member, which compensates in a satisfactory manner and in real time the above changes in length.

As such changes affect obviously also the patient supporting plane 7, the compensation is entrusted to the elasticity of the same plane or to the adoption of a set of springs, not shown, between one of the two smaller sides of the plane and one of the two crossbars.

Figure 8:
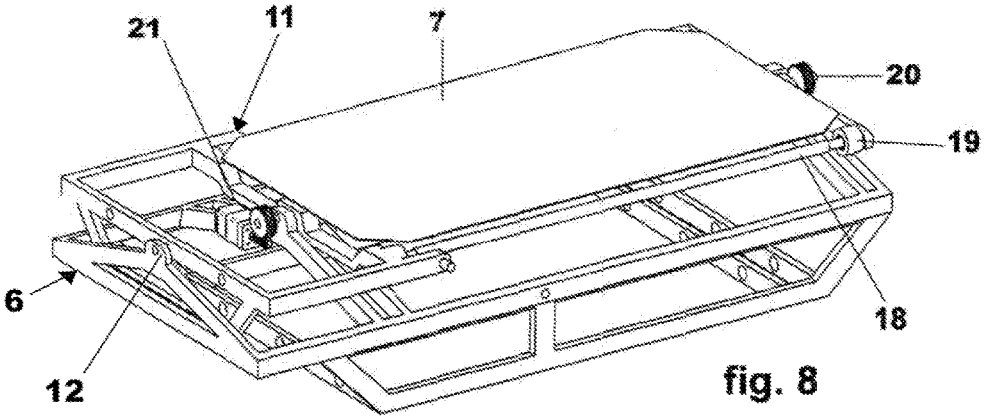
FIGS. 8 to 12 are a perspective view, a side view, a partial top view all showing the bed with its patient supporting plane being horizontally positioned, and two different partial perspective views showing the bed with its patient supporting plane being twisted, according to the invention.
Figure 9:
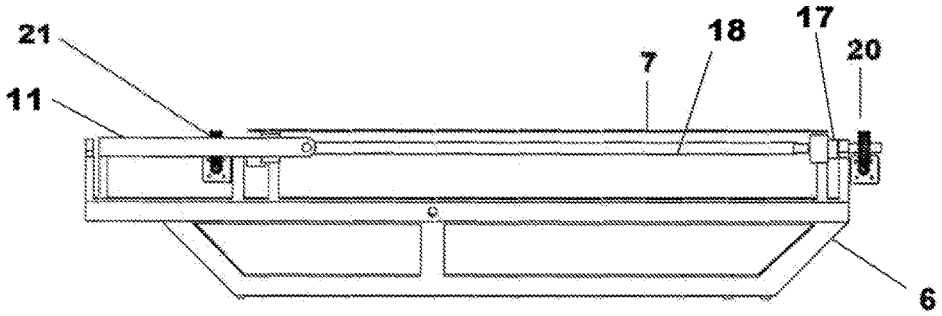

Starting from the horizontal position of the patient supporting plane shown in FIG. 8, FIGS. 11 and 12 display further positions in the twisting motion caused by the inclination of the two crossbars 11, 17 and the two longitudinal members 18 that support the patient supporting plane 7.

In FIG. 8 the two crossbars are oriented horizontally, and thus the patient supporting plane is in the same situation.

In FIG. 11 the foot crossbar 11 is 15 degrees inclined to the head crossbar 17, situation that leads to a corresponding rotation of the patient's pelvis.

FIG. 12 shows that the patient supporting plane 7 is completely twisted. In fact, the foot crossbar 11 and the head crossbar 17 are 15 degrees inclined but in the opposite direction relative to one another, with a total angle of rotation of 30 degrees between the scapular-humeral region and the lumbosacral region of the patient. These positions are also shown in the end views in FIGS. 22 to 27.

With reference to FIG. 8 one can see that the angular movement of the two crossbars 11, 17 occurs through the geared motor 20 for the head crossbar 17 and the geared motor 21 for the foot crossbar 11.

There are limit switches and mechanical locking mechanisms designed to prevent angular movements of magnitude higher than expected.

In FIGS. 13 to 17 the structure of the bed 6 is shown in enlarged details in the portion relating to the seat/leg support.

The sitting plane 8, when the bed 6 is located in a vertical position, as already shown in FIG. 1, acts as a seat, and therefore it must be located in a position perpendicular to the patient supporting plane 7 of the bed 6 and the legs 9 at 90 degrees to the sitting plane 8. Once the patient supporting plane 7 is in operating positions, the sitting plane 8 and the legs 9 take mutual angles with respect to the patient supporting plane 7 that are variable depending on the needs. The sitting plane 8, furthermore, when it serves together with the legs 9 as a leg support for the patient, must be able to vary its length to fit the femoral length or the proximal portion of patient's lower limbs.

Since then the twist of the patient supporting plane 7 at the lumbosacral side also involves a corresponding tilting movement of the legs, the sitting plane 8 is pivoted not on the bed 6, but on its foot crossbar 11, so that the legs have the same inclination of patient supporting plane 7 in twisting.

Figure 16:
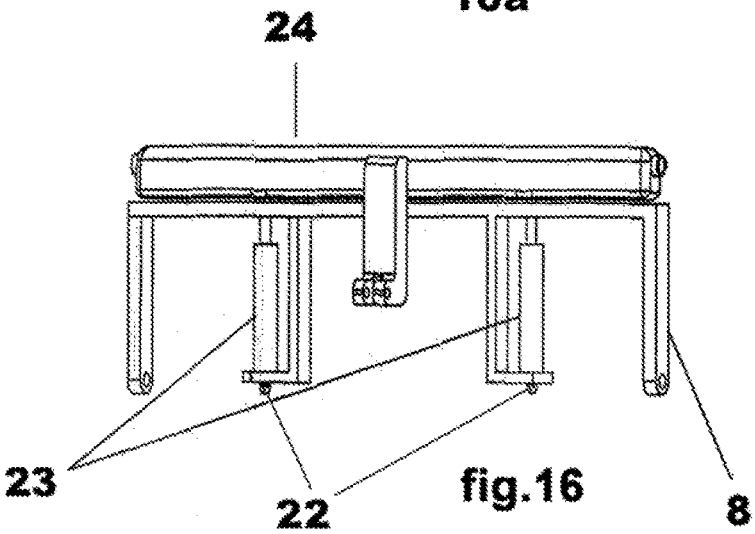
FIGS. 16 and 17 are two perspective views of another part of the seat/leg support in FIG. 13 in two different arrangements.
Figure 17:
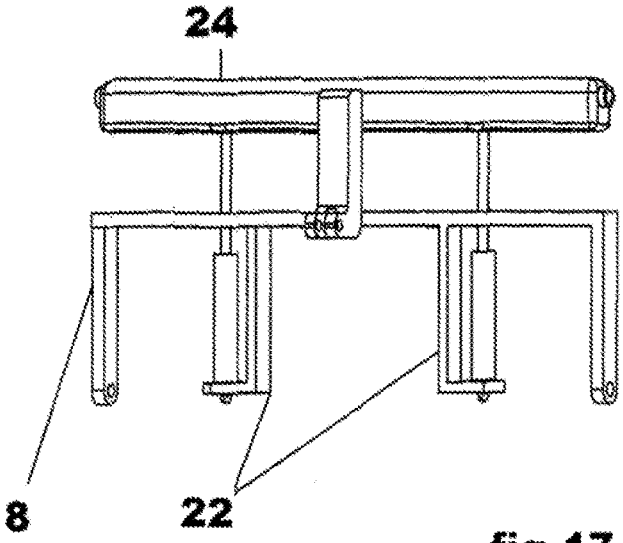
Figure 18:
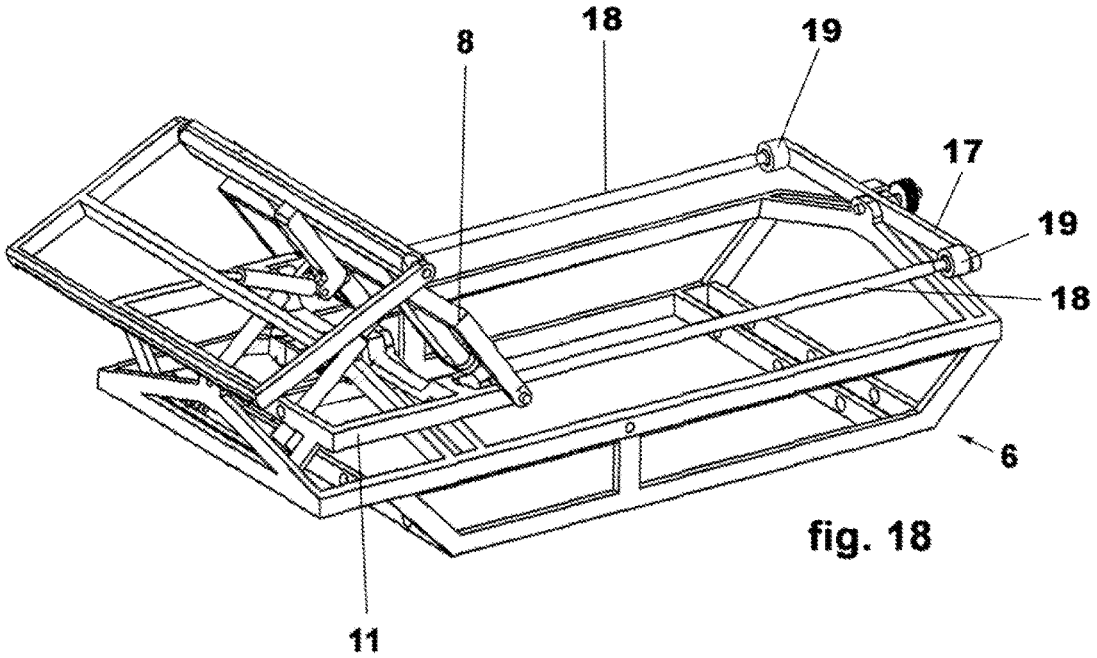
FIGS. 18 and 19 are a perspective view and an end view of the bed according to the invention being horizontally positioned.
Figure 19:
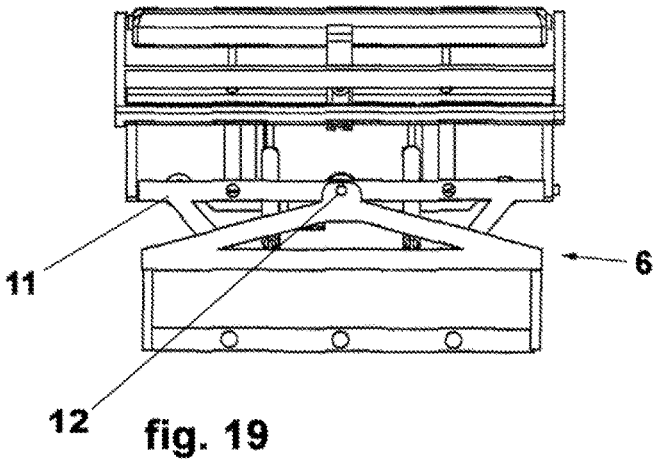
Figure 20:
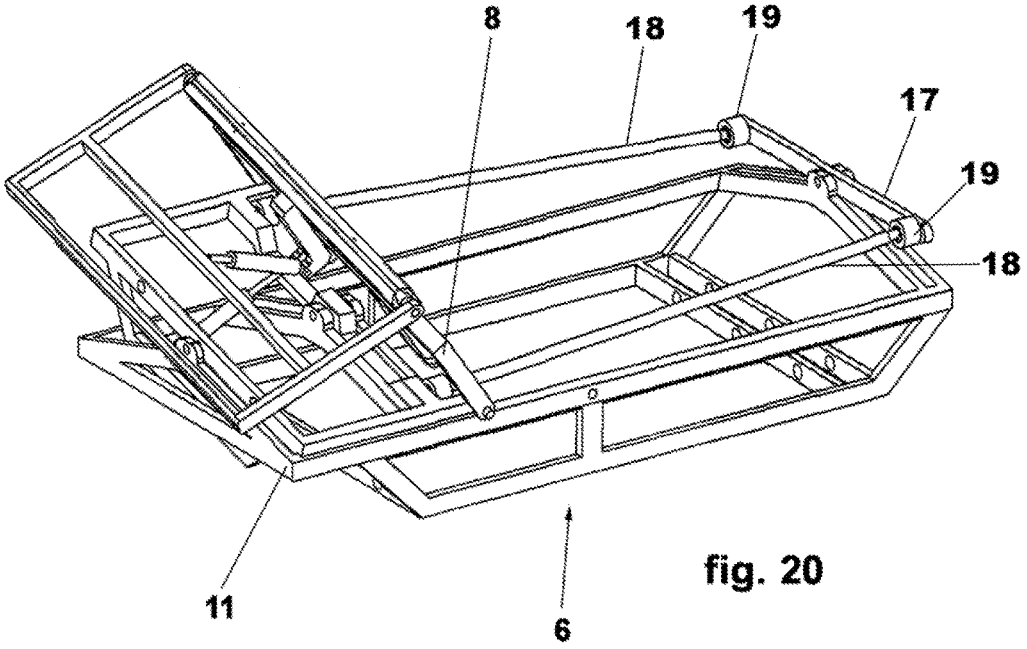
FIGS. 20 and 21 are a perspective view and an end view of the bed according to the invention being twisted.
Figure 21:
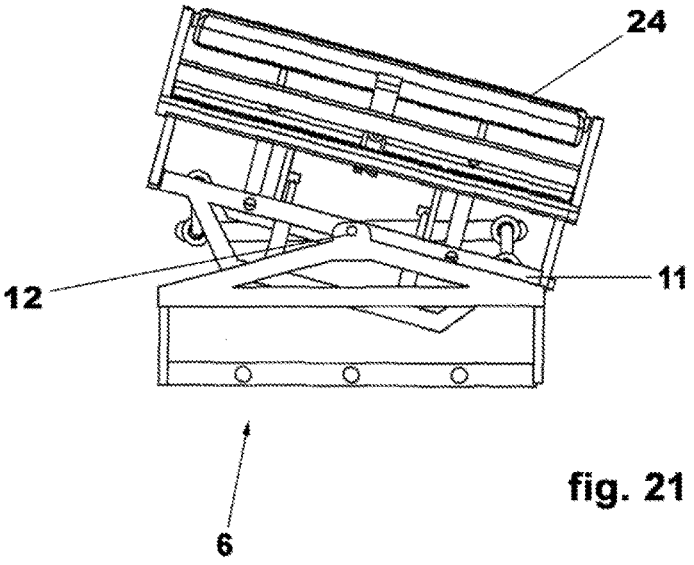

With reference also to FIGS. 16 and 17 which are partial views of the sitting plane 8, a sleeve-shaped spacer 24, forming part of the legs 9, is mounted in front of the sitting plane 8, the spacer 24 being able to move forwards or backwards thanks to two electric or hydraulic linear actuators 23, being mounted on supports 22 forming part of the sitting plane 8. The spacer 24 is in a shortened position and in an extended position in FIG. 16 and in FIG. 17, respectively. All the intermediate positions are possible between the two above extreme positions.

The legs 9 are pivoted on the spacer 24 (FIGS. 13 and 14), and the sitting plane 8, acting as a leg support together the legs 9, is pivoted on a pin 10 of the side sections 10*a*, 10*b* of the foot crossbar 11.

The inclination of the sitting plane 8 with respect to the patient supporting plane 7 of the bed 6 is controlled by the two linear actuators 26, and the inclination of the legs 9 is operated by the linear actuator 25.

Also the actuators 25 and 26, as well as the actuators 23, may be electrical or hydraulic.

The foot crossbar 11, in turn, is pivoted to the bed 6 through pins and bearings on respective seats 12 of the bed 6 and respective seats 12 of the cross members 12*a*, 12*b* of the foot crossbar 11, and can tilt at the right-hand or left-hand up to 15 degrees.

Figure 22:
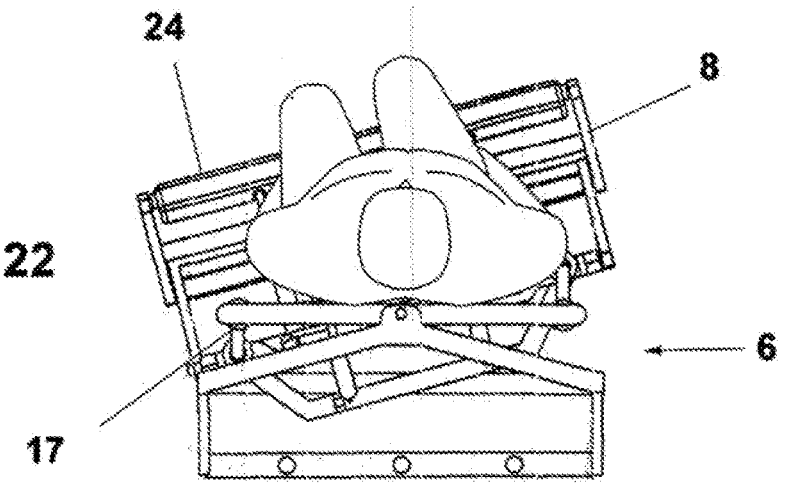
FIGS. 22 to 27 are end perspective views of a bed according to the invention on which a patient is placed supine in six different positions.
Figure 23:
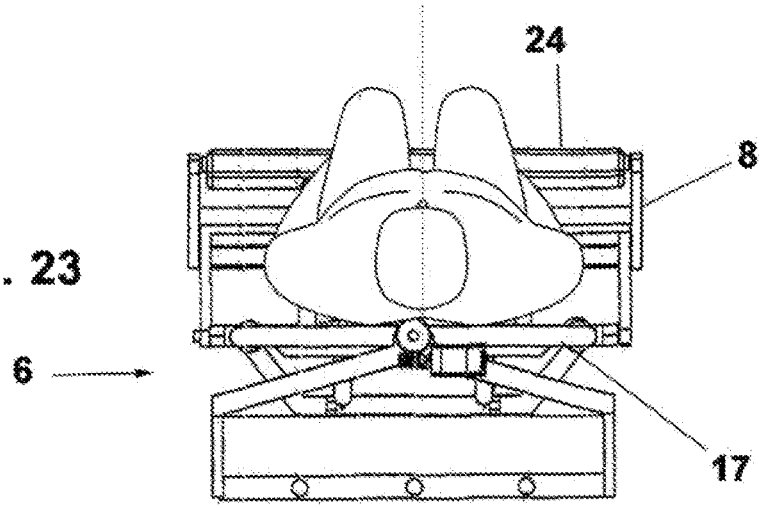
Figure 24:
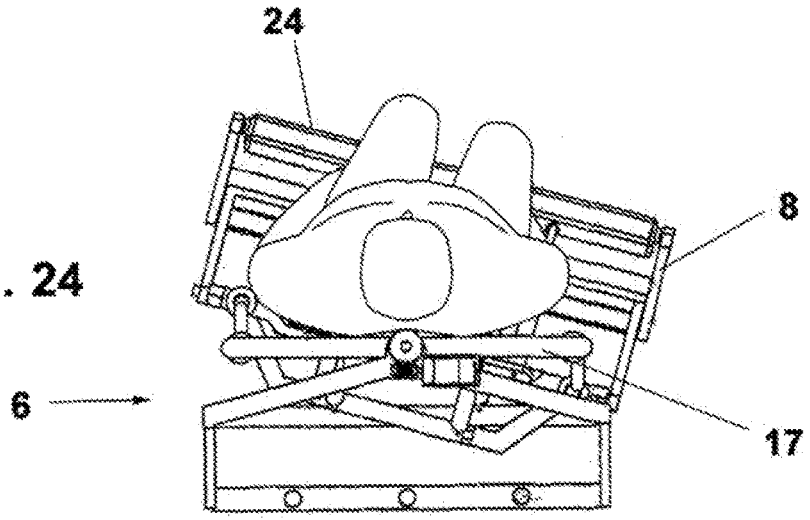

FIGS. 18 to 21 show the dependence of the inclination of the sitting plane 8 in relation to the inclination of the foot crossbar 11 as they are connected together, when the lower part of the patient supporting plane 7 is twisted. FIGS. 22 to 24 show, in end views, three typical twisting situations of the lower part of the patient supporting plane 7. FIG. 22 shows a torsion of the lumbosacral part of 15 degrees to left-hand, in FIG. 23 there is no torsion, and the patient's body is located horizontally, in FIG. 24 there is a twist of 15 degrees to right-hand. The patient's legs follow the inclination of the lumbosacral part, and, as a consequence, there is the need of an inclination of the sitting plane 8 and the legs 9 operating together as leg support according to the twisting degree of the lower part of the patient supporting plane 7.

Figure 25:
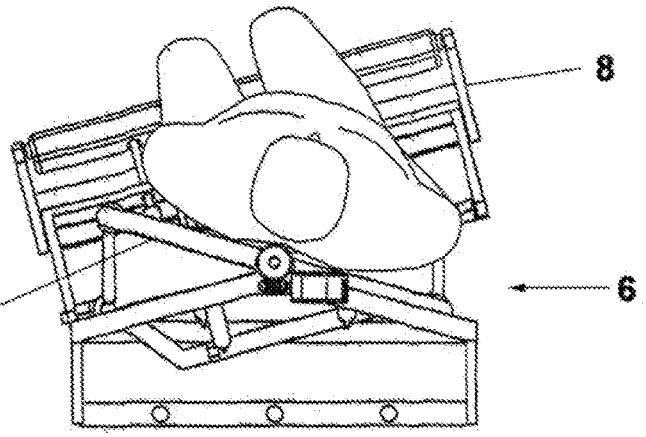
Figure 26:
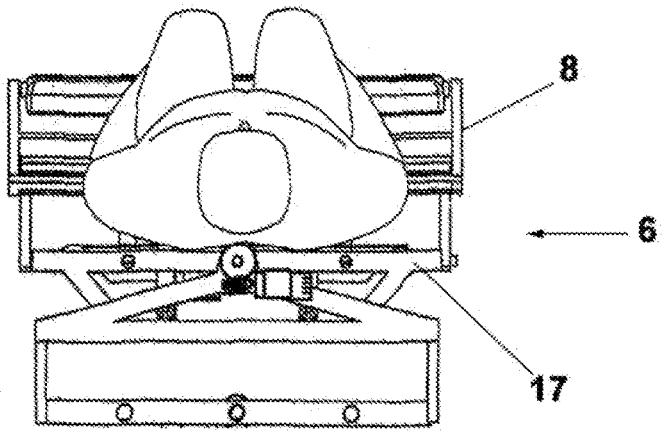
Figure 27:
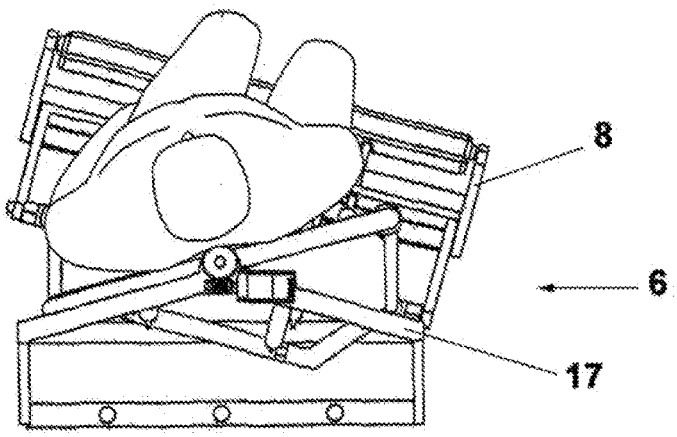

FIGS. 25 to 27 show, in end views, a simultaneous torsion of the scapular-humeral region and the lumbosacral region, 15 degrees on either side and the one in opposite direction to the other.

Shown in the perspective view of FIG. 28 is the massage apparatus, which is an integral part of the bed 6 and constitutes the real operative part of the machine. Arranged transversely with respect to the bed, are massaging roller systems 27 and massaging planetary systems 28, as well as pairs of series of idle transverse rollers 29 and 30 that, even if they exert a certain massage action, have substantially a filling and supporting function in order to ensure a continuity of support of the patient's body on the patient supporting plane 7 regardless of the position of the roller systems 27. The massaging roller systems 27 and massaging planetary systems 28, as well as pairs of series of idle transverse rollers 29 and 30 as supporting means are sustained by a second frame twistably mounted on the first frame about an axis parallel to the longitudinal axis of the first frame under the patient supporting plane 7, as seen in the following.

The enlarged perspective views of FIGS. 29 and 30 show a massaging roller system 27 and a massaging planetary system 28.

The massaging roller system 27 is constituted by a set of large rolls 33 and small rolls 34 that are pivoted on four shafts 31 disposed between two gears 32 which serve as a coupling to movement transmission members described later. At the center of the massaging roller system 27 there is a large roller 35 crossed by the four shafts 31.

The large rolls 33 and the small rolls 34 alternate during the rotation of the massaging roller system 27, which is performed about a central journal 36 of each of the two gears 32, and the large roller 35 advance along the center line of the patient's spinal column.

The massaging planetary system 28 as represented in FIG. 30 shows two large rolls 33 and two small rolls 34, which rotate about two orthogonal small shats 37, which are arranged on two different heights to compensate for the difference in diameter of the rolls 33 and 34.

Figure 31:
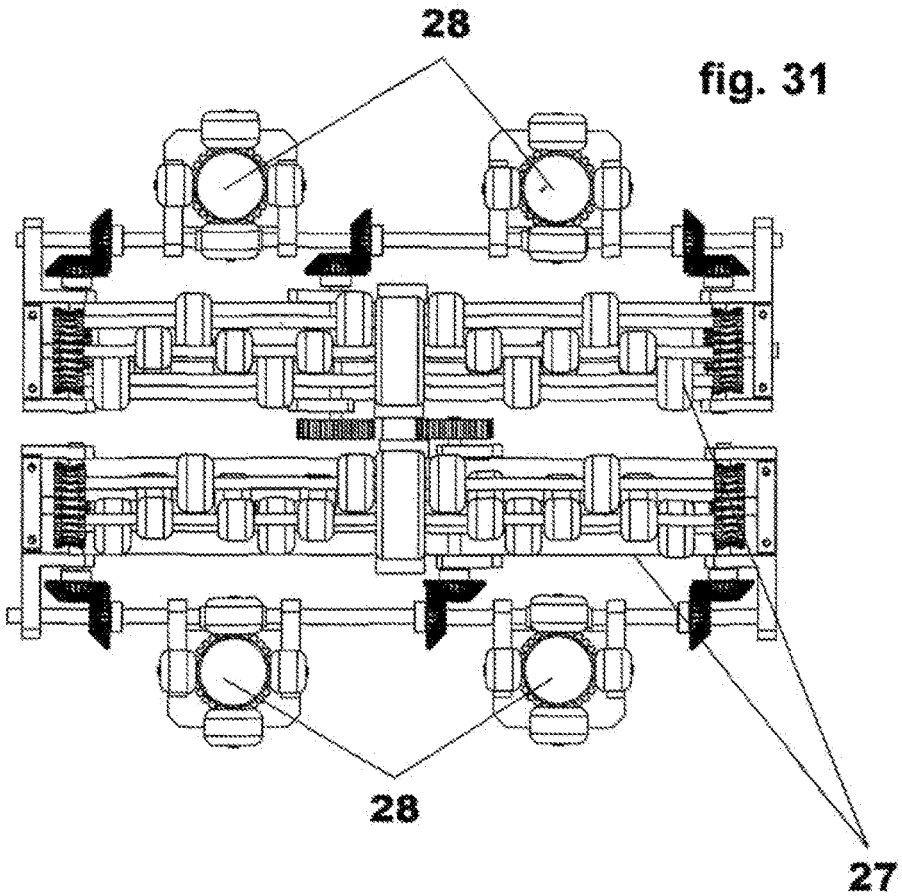
FIGS. 31 and 32 are a plan view and a perspective view respectively, of the massage apparatus in FIG. 28.
Figure 32:
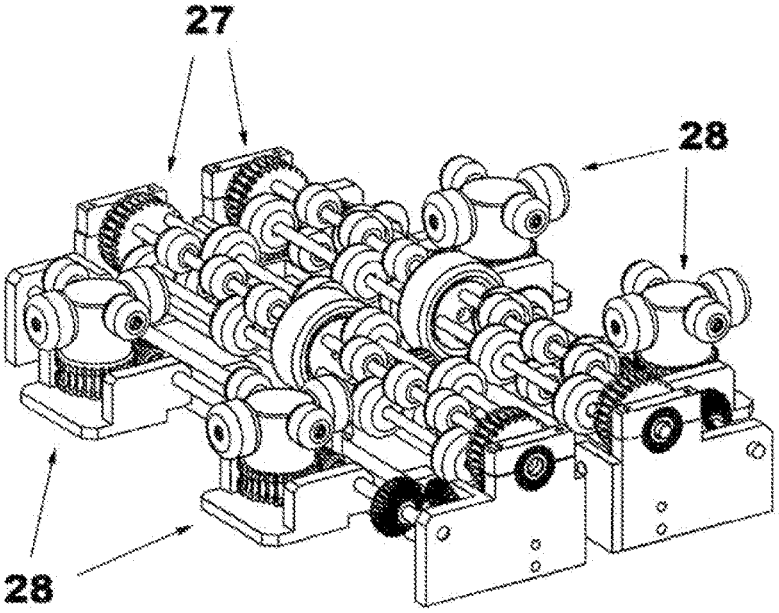

As already shown in FIG. 28, the massage apparatus, as seen also in FIGS. 31 and 32 that are a top view and a perspective view respectively, comprises two massaging roller systems 27 and four massaging planetary systems 28. During the massage, both the planetary rollers rotate in opposite directions relative to one another, to ensure a centrifugal or centripetal massage action depending on the direction of mutual rotation of the rollers.

The above massage apparatus, in addition to the described rotational movements, moves in both directions along the longitudinal axis of the first frame of the bed 6. Also, when the patient support plane 7 is being twisted, also the massaging roller systems must follow the degree of inclination thereof that is always different point by point along the longitudinal axis. The massage apparatus according to the invention is done so that the two massaging roller systems are independent of each other so that each one can take the required inclination and slide on guides capable of synchronously following the twisting movements of the patient supporting plane. Further, the motion to rolls, rollers, and planetaries has to be transmitted in any inclined situation.

FIGS. 33 to 36 show in perspective views by means of hydraulic or pneumatic or linear actuators 38, the massaging planetary systems 28 may be lowered, even separately from each other, since each one has its own actuator.

The lowering of the one or the other pair of massaging planetary systems is however provided at each upper or lower stroke end, i.e. head or foot end, of the massage apparatus, to permit the massaging roller systems 27 to carry out their action also on the points of the patient's body that are already treated by the massaging planetary systems.

FIGS. 33, 34, 35, and 36 show in different projections a situation in which two massaging planetary systems are reclined and two massaging planetary systems are active. The actuators 38, which make possible such movements, are below the massage apparatus, as shown in particular in the enlarged detail in FIG. 36.

The mechanics of the massaging roller systems 27 and of the massaging planetary systems 28 are shown in FIGS. 37 to 40, which are a whole perspective view, a detailed perspective view, a top plan view and an exploded perspective view of the same mechanics, respectively. In order to transmit the movement of a motor 40 to the aforesaid massaging roller systems 27 and massaging planetary systems 28, support frames 45 and 45-A thereof are horizontal and parallel to one another only when the patient supporting plane 7, under which they are arranged, does not work being twisted; on the contrary when the patient supporting plane 7 is being twisted, the support frames 45 and 45-A are inclined relative to one another in proportion to the type and degree of twist of the patient supporting plane 7.

The support frames 45 and 45-A swing around a central axis 41 to follow the inclinations of the patient supporting plane 7 and also move in both directions along said axis.

In order that the two support frames 45 and 45-A swing, the central axis 41 is that of a threaded shaft 41-A. Made in the two support frames 45 and 45-A are through holes 41-B (FIG. 37) that are also counter-threaded with the same pitch and diameter of the threaded shaft 41-A. Referring to the top perspective view of FIG. 41 that has been lightened of said mechanics for clarity sake, the rotation of the threaded shaft 41-A, which is coupled to a motor 41C through a reduction gear 41-D produces the aforesaid longitudinal displacements.

Figure 38:
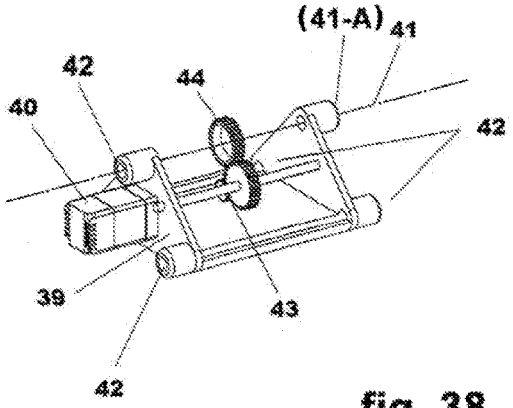
FIG. 38 is an enlarged perspective view of a detail in FIG. 37.

With respect to the handling of massaging roller and planetary systems, they are driven by the motor 40 that is mounted directly on the gearbox 39 through transmission organs consisting of a reduction gear 43 and a free coupling gear 44, as best shown in FIG. 38.

Figure 37:
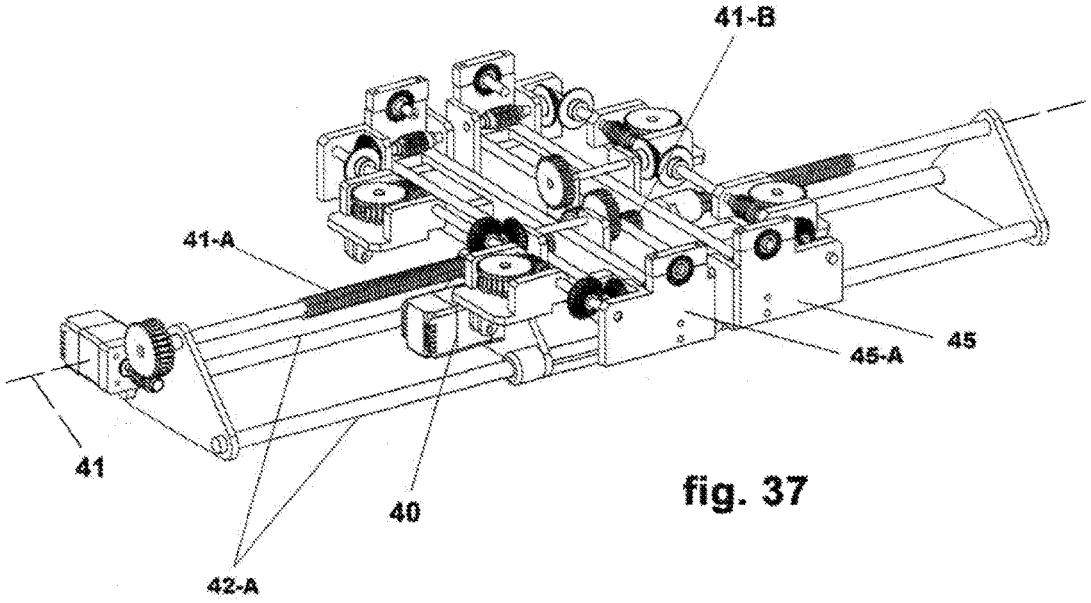
FIG. 37 is a perspective view of the massage apparatus of the machine in FIG. 28, the massage apparatus being without both frame parts and roller and planetary systems.

The gearbox 39 moves together with the two support frames 45, 45-A by means of the threaded shaft 41-A that advances through the threaded holes of axis 41 of the gearbox 39. The gearbox 39 runs on two cylindrical guides 42-A being parallel to the shaft 41-A, as shown in FIG. 37, and passing through holes 42 of the same gearbox 39 (FIG. 38). The two cylindrical guides 42-A are not subject to inclination. The support frames 45 and 45-A, being pivoted only on the shaft 41-A, can oscillate freely with respect to the latter.

Figure 39:
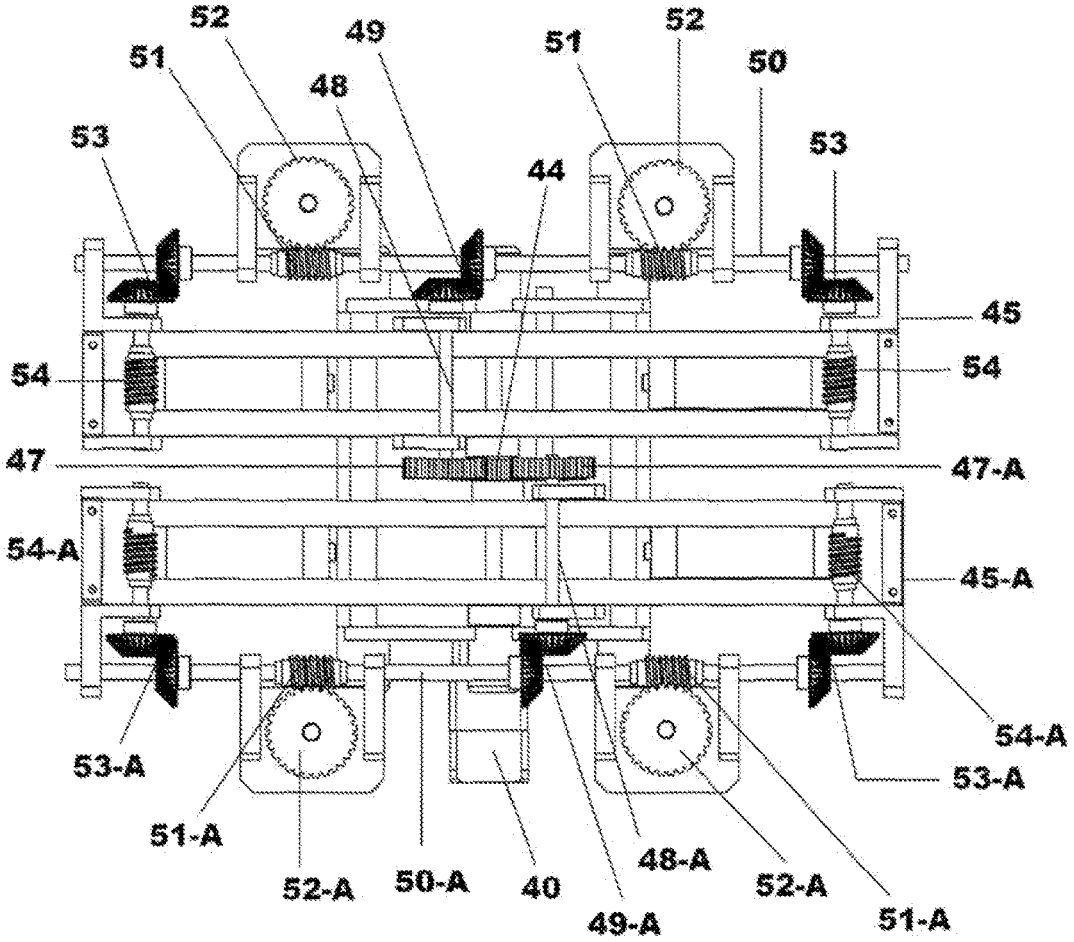
FIG. 39 is a top plan view of a portion in FIG. 37.

FIG. 39 describes the transmission of the movements to the massaging roller systems 27 and the massaging planetary systems 28. For descriptive simplicity reference will be made below only to the support frame 45 given that the two support frames 45, 45-A are equal to each other, the parts of the other support frame 45-A being distinguished only by the fact that all the reference numerals thereof are followed by letter A.

Figure 33:
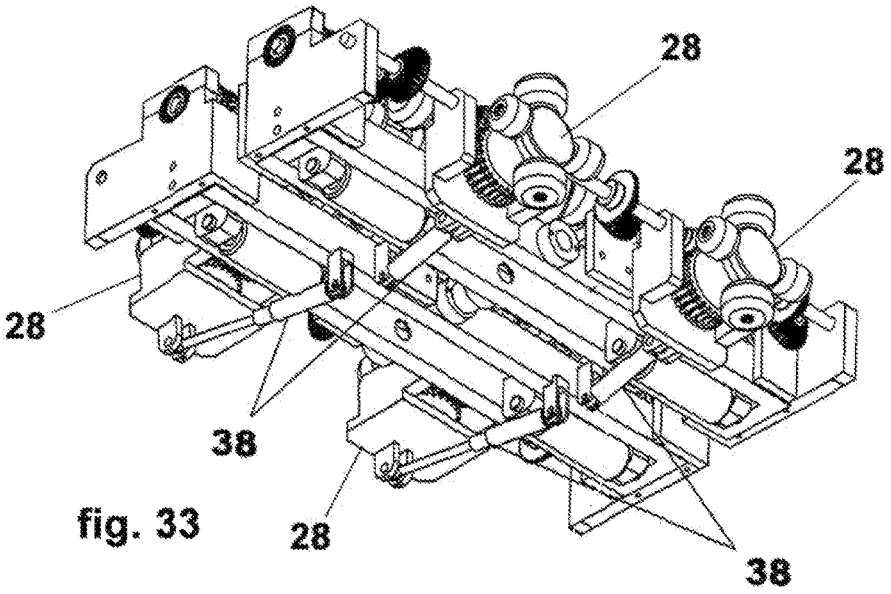
FIGS. 33 and 34 are perspective views from below and above respectively, showing a couple of planetary systems being rotated downward, in the massage apparatus in FIG. 28.
Figure 34:
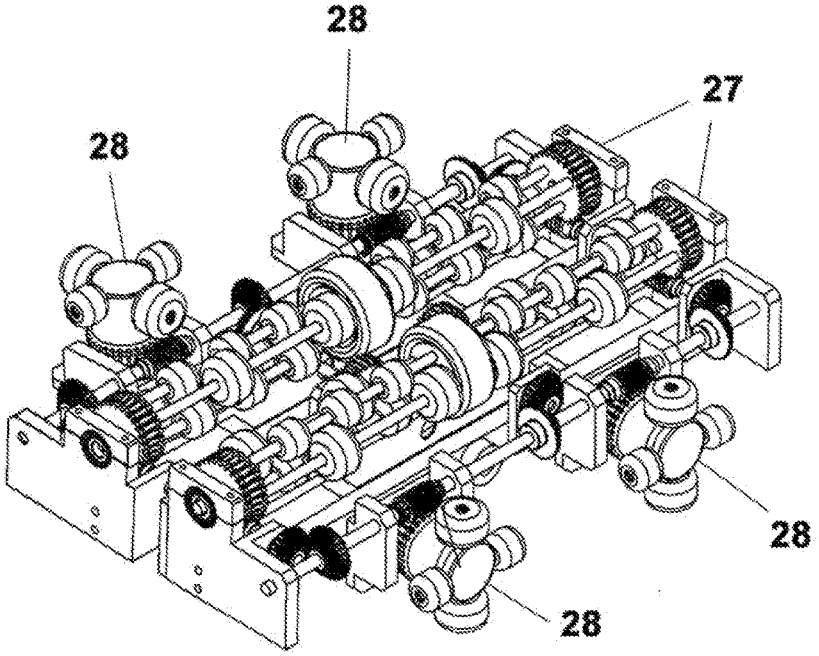
Figure 35:
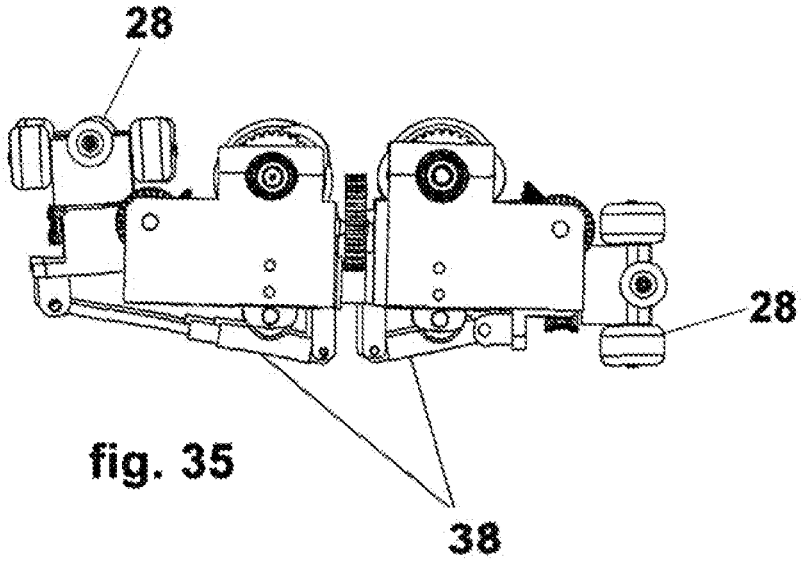
FIG. 35 is a side view of the massage apparatus in FIG. 28.
Figure 36:
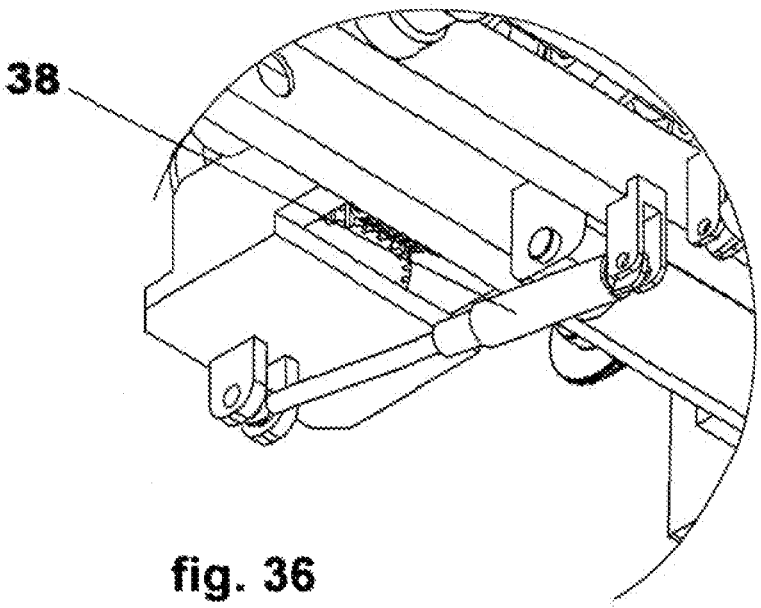
FIG. 36 is an enlarged detail of the massage apparatus shown in FIG. 28.

Referring to FIG. 38, the reduction gear 43 transmits the rotational movement to the free coupling gear 44 that is concentric to shaft 41-A and free to move longitudinally on it. Meshed with the free coupling gear 44 are two gears 47 and 47-A that are part of the support frames 45 and 45-A, respectively. This arrangement permits the movement of the gears to be transmitted regardless of the fact that the two support frames 45, 45-A are aligned or misaligned with each other and with respect to the gearbox 39. The gear 47 transmits the movement by a shaft 48 to the bevel gear 49 and, by the latter, to a shaft 50. Mounted on the shaft 50 are two worm screws 51 that are coupled to gears 52 whose supports are hinged on the same shaft 50 so that gears 52 are allowed to be lowered through the actuators 38 as seen in FIGS. 33, 35, and 36.

Placed on the gears 52 are the massaging planetary systems 28. The two pairs of gears and worm screws 51-52 have a right hand pitch and a left hand pitch respectively as the massaging planetary systems 28 must rotate in an antagonistic manner to one another.

At the two ends of the shaft 50 there are also two bevel gears 53 that transmit their movement to two worm screws 54 near the two ends of the frame.

Figure 40:
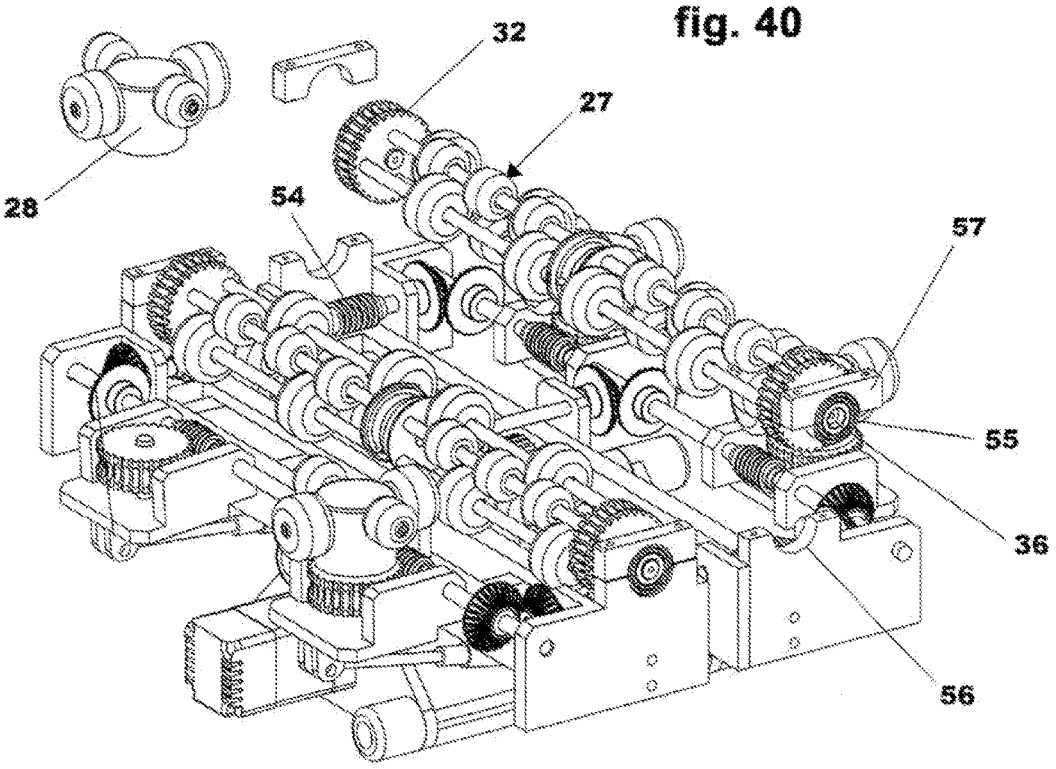
FIG. 40 is a partially exploded perspective view of the massage apparatus in FIG. 32.

The two massaging roller systems 27, as shown in the perspective view of FIG. 40, are mounted on seats 56 by means of bearings 55 positioned about the shafts 36 of the two rollers 36 of the two gears 32 of the massaging roller systems and blocked by four bearing covers 57. In this way, the gears 32 of the massaging roller systems are in contact with the worm screws 54 and 54-A of the two support frames 45 and 45-A and can rotate in synchronism with the massaging planetary systems 28.

Since the rolls of the massaging roller systems, like the planetaries in the massaging planetary systems, must rotate in opposite directions, the worm screws 54 and 54-A must have different pitch that is right-hand for a pair and left-hand for the other one.

Illustrated with reference to FIGS. 41 to 53 is the means by which the massaging roller systems 27 and massaging planetary systems 28, as well as the series of idle transverse rollers 29 and 30 as supporting means are sustained by a second frame twistably mounted on the first frame about an axis parallel to the longitudinal axis of the first frame under the patient supporting plane 7

In particular, FIG. 41 is a perspective view of the bed with parts being removed for clarity of illustration, and FIG. 42 is an end view of the bed in FIG. 41. FIGS. 41 and 42 show construction details of upper and lower frames both forming said second frame. The massage apparatus, already presented in FIG. 28, is adapted to slide between said upper and lower frames that allow the massaging roller systems to twist and to move forward and backward.

As seen, oscillating lower cross members 59, 59-A, and oscillating upper cross members 60, 60-A are pivoted on a support bench 58 by small shaft 59-B, 60-B, respectively.

The upper and lower cross members are connected together by tie rods 61 so as to uniform their movements of radial oscillation. Lower and upper telescopic longitudinal members 62, 63 are connected to the lower cross members 59, 59-A and upper cross members 60, 60-A, respectively.

The connection between the telescopic longitudinal members and the cross members is performed by ball joints 19-B, which function as described above with reference to the ball joints 19 of the frame of the patient support plane 7.

The idle transverse rollers 29 and 30 already described with reference to FIG. 28 slide on the upper telescopic longitudinal members 63.

Figure 44:
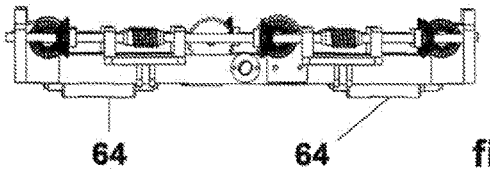
FIG. 44 is a partial end view of the massage apparatus in FIG. 43.

Supporting rollers 64 are mounted under the support frames 45 and 45-A and engage the lower telescopic longitudinal members 62 for the movement of the support frames 45 and 45-A, as shown in particular in FIG. 44.

As above said, the massage apparatus with its massaging roller systems and planetary systems is slidably mounted by means of its two support frames 45 and 45-A between the lower and upper frames that are separately visible in FIG. 41. Inside the box 39 there are reduction gears of the motor 40 and the gear coupling for the rotation of the massaging roller systems and the massaging planetary systems as already described.

The threaded shaft 41-A passes through the threaded holes of the gearbox 39 (FIG. 38) and the counter-threaded holes 41-B of the two support frames 45, 45-A. The rotation of the threaded shaft 41-A produces the longitudinal movement of the massage apparatus.

Electronically or manually adjustable limit stops are provided for limiting the travel of the massage apparatus to the actual extension of the patient's area designed to the treatment.

Figure 43:
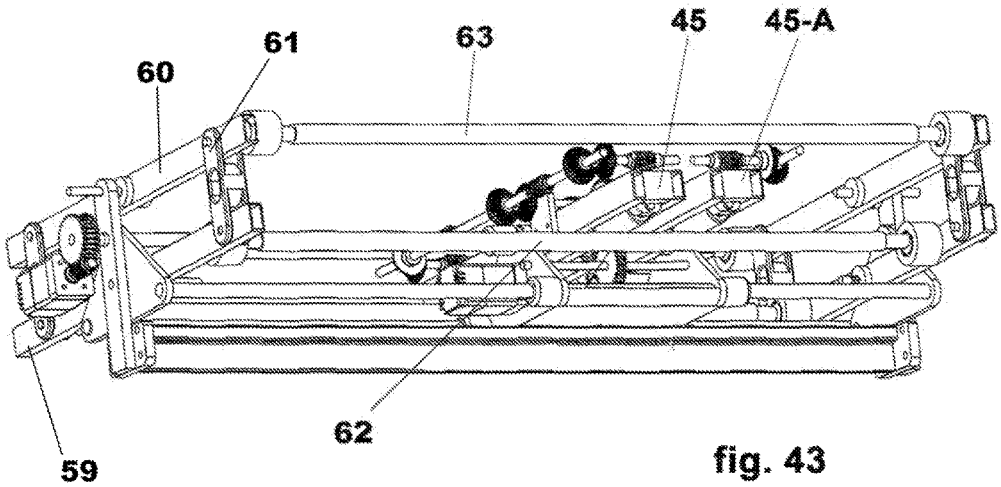
FIG. 43 is a partial perspective view from below of the massage apparatus and of the frame in FIG. 28.
Figure 45:
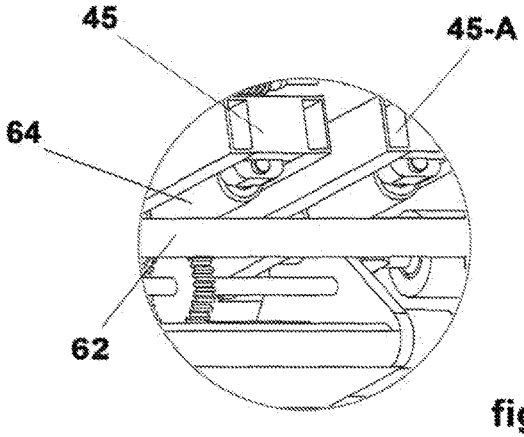
FIG. 45 is a partial perspective view of the frame in FIG. 43.

With reference to the perspective views of FIGS. 43 to 45, they show that the support frames 45, 45-A travel on the threaded shaft 41-A and are sustained along their run on the lower telescopic longitudinal members 62 through the support rollers 64 mounted at the two ends of the support frames 45, 45-A, below the same frames.

Figure 46:
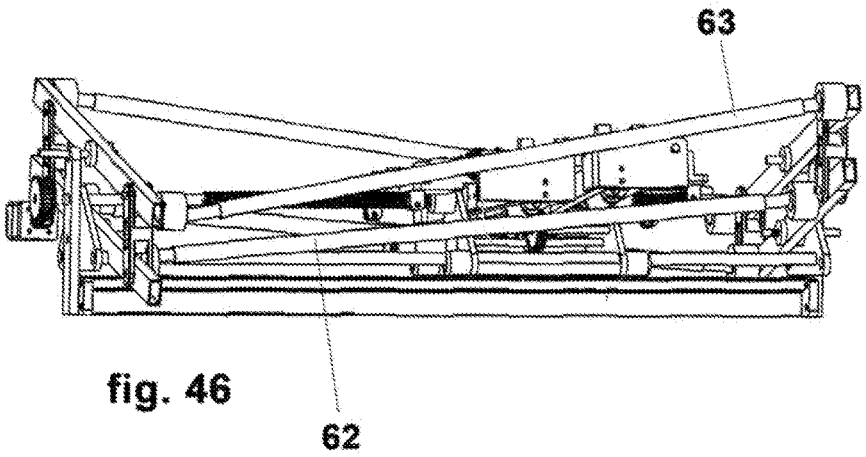
FIG. 46 is a side perspective view of the frame in FIG. 43 being twisted.
Figure 47:
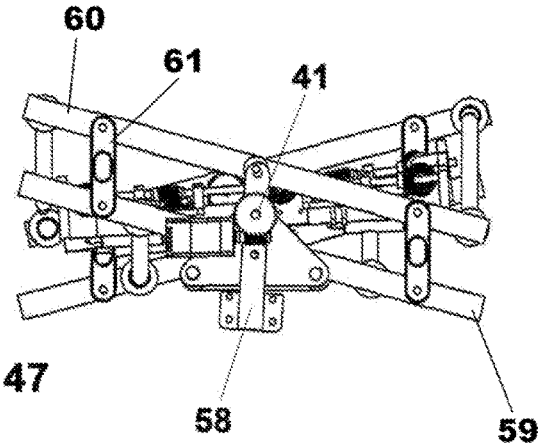
FIG. 47 is an end view of the frame in FIG. 43 being twisted.
Figure 48:
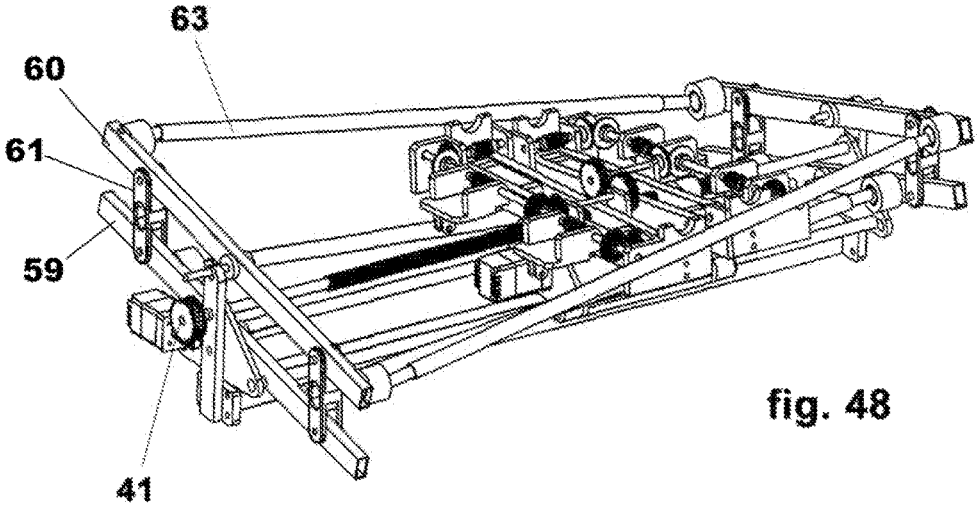
FIG. 48 is a top perspective view of the frame in FIG. 43 being twisted.

With reference to the perspective views of FIGS. 46 to 48, effects of twisting of the patient supporting plane on the second frame and, consequently, on the massaging roller and planetary systems are illustrated.

The arrangement of the telescopic longitudinal members can be flat or inclined depending on the position of the cross members. The inclination of the latter involves the simultaneous inclination of the telescopic longitudinal members 62, which tilt the one opposite to the other, causing the simultaneous inclination of the two lower and upper frames. Thus the two lower and upper frames also undergo a misalignment whose magnitude depends on the degree of inclination of the cross members and, consequently, of the telescopic longitudinal members.

Figure 49:
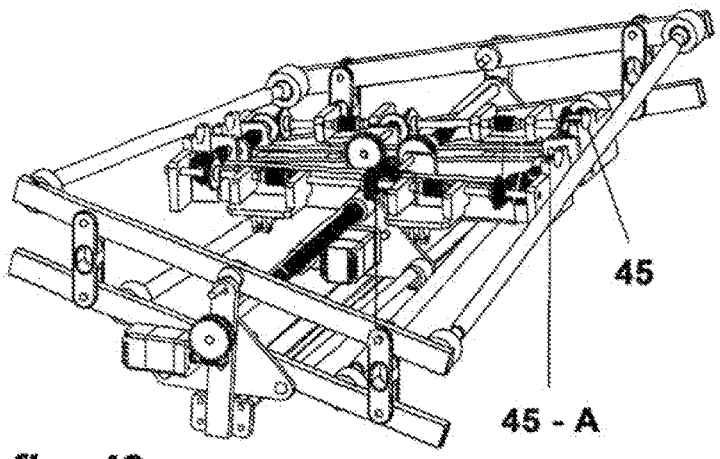
FIG. 49 is a perspective view from above of three quarters of the frame in FIG. 43 being twisted.
Figure 50:
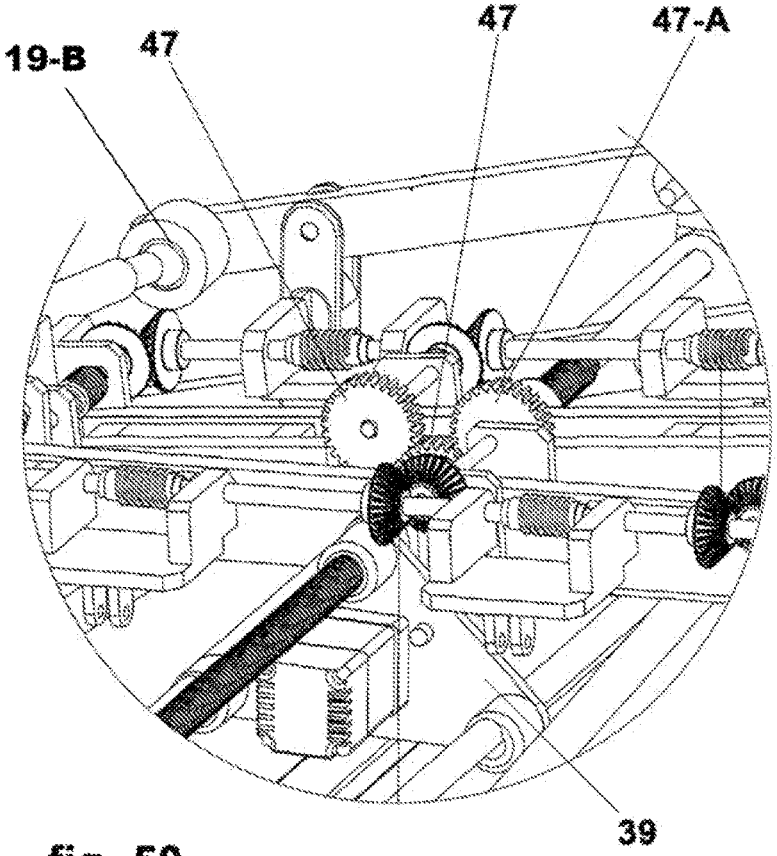
FIG. 50 is an enlarged partial perspective view of a detail of the upper frame in FIG. 49.

In FIG. 49 and in its enlarged view of FIG. 50, there is shown in a perspective view that the transmission of the movement to the two gears 47 and 47-A is allowed in any condition of alignment of the two lower and upper frames, by virtue of the free coupling gear 44 of the gearbox 39.

Figure 51:
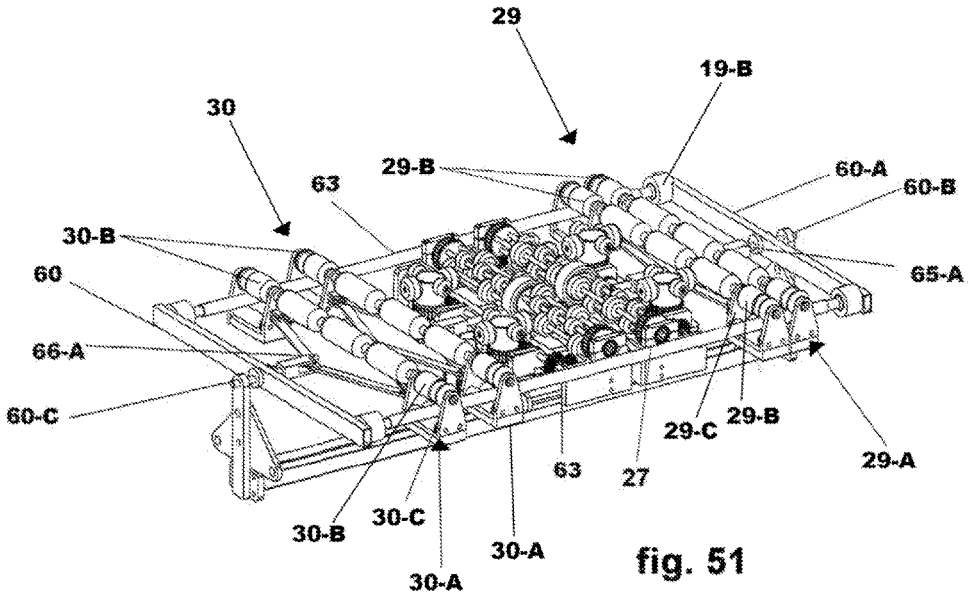
FIG. 51 is a top perspective view of the massage apparatus and relevant upper frame in FIG. 28 without lower frame.
Figure 52:
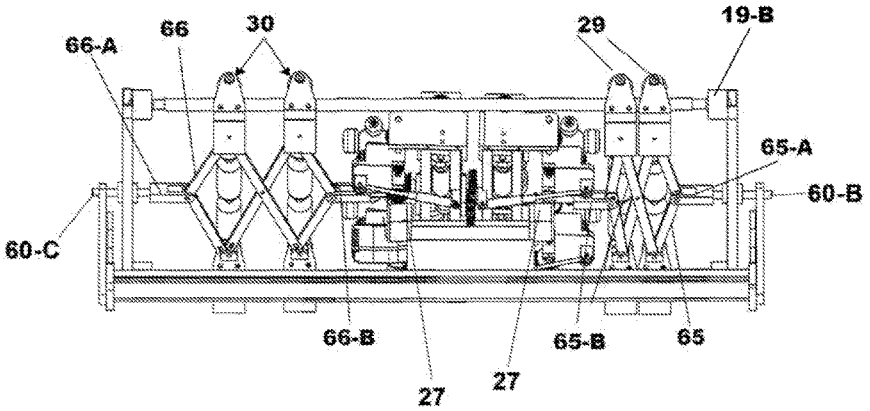
FIG. 52 is a side view of the massage apparatus and the upper frame in FIG. 51 being twisted.

In FIGS. 51 and 52, which are a perspective view from above and below of the massage apparatus, there is shown that the massage apparatus is completed by the idle transverse rollers 29 and 30 which have the task of ensuring continuity of support for the patient, even when the massaging planetary systems are lowered and therefore the area of support on the massaging roller systems has a limited extension.

The pairs of idle transverse rollers 29 and 30 are coupled to a pantograph 65 and a pantograph 66, respectively. In turn, the pantograph 65 is connected by a fork 65-A to the small shaft 60-B of the oscillating upper cross member 60-A and by a fork 65-B to the massaging roller system27, and the pantograph 66 is connected to the massaging roller system27 by a fork 66-B and a small shaft 60-C through a fork 66-A.

As a result, two anchor points obtained by the forks 65-A and 66-A are fixed, and the two anchor points obtained by the forks 65-B and 66-B are movable, being bound to the massaging roller systems 27.

The arms of the pantographs 65, 66 further engage support elements sustaining the idle transverse rollers 29, 30 on the upper telescopic longitudinal members 63. With reference to FIG. 51, such support elements, which are indicated as 29-A, 30-A with respect to the idle transverse rollers 29, 30, are generally U-shaped having wings connected to a core. The wings have free wings in which an upper roller 29-B, 30-B is pivoted, and rollers 29-C, 30-C are pivoted to the same wings near the core. The upper rollers 29-B, 30-B in the idle transverse rollers 29, 30 have a groove engaging the upper telescopic longitudinal members 63.

Depending on the direction of movement of the massaging roller system27, one of the two pantographs opens and the other closes, and vice versa.

Since the pairs of idle transverse rollers 29 and 30 are mounted on the pantographs 65 and 66, series of parallel rollers inside each pair approach each other when the pantograph closes and are removed from each other when the pantograph opens.

Figure 53:
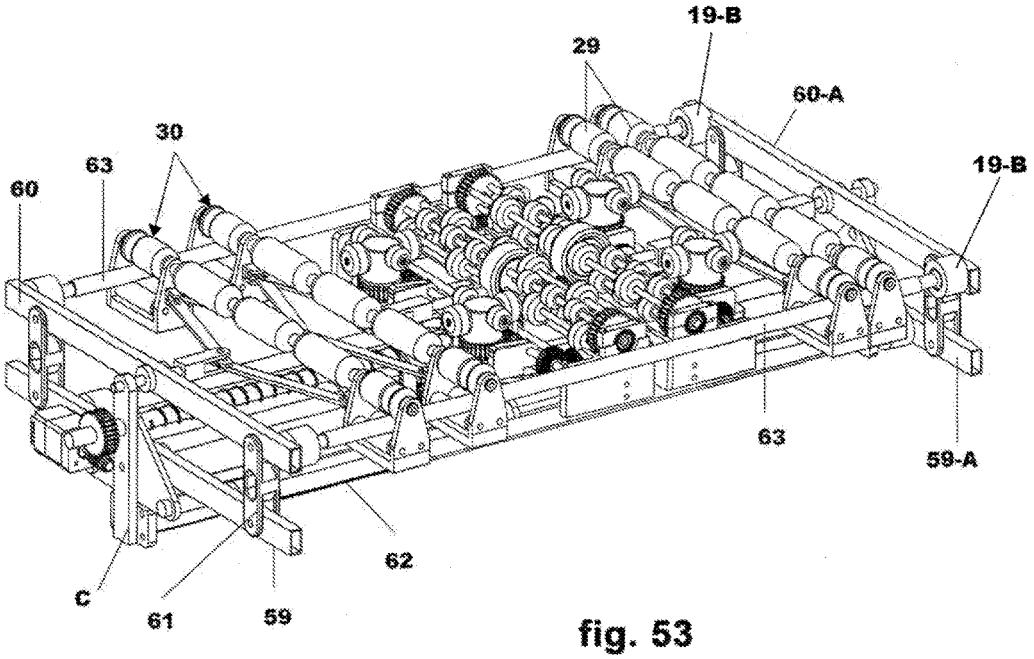
FIG. 53 is a full top perspective view of the massage apparatus and of the frame in FIG. 28.

FIG. 53 shows, in a perspective view, the massage apparatus complete with all its components.

The two oscillating upper cross members 60 and 60-A together with the upper telescopic longitudinal members 63 are the support of idle transverse rollers 29 and 30. These rollers being connected to the massage apparatus, can slide flat or inclined according to the mutual inclinations of the oscillating upper cross members.

The oscillating lower cross members 59 and 59-A and the relative telescopic longitudinal members 62 adjust the position of the massage apparatus, i.e. flat or inclined.

Since the upper and lower cross members are connected together through the tie rods 61, they simultaneously perform the same movements of inclination, and therefore also the massage apparatus and the idle transverse rollers 29 and 30 have the same inclination.

Figure 54:
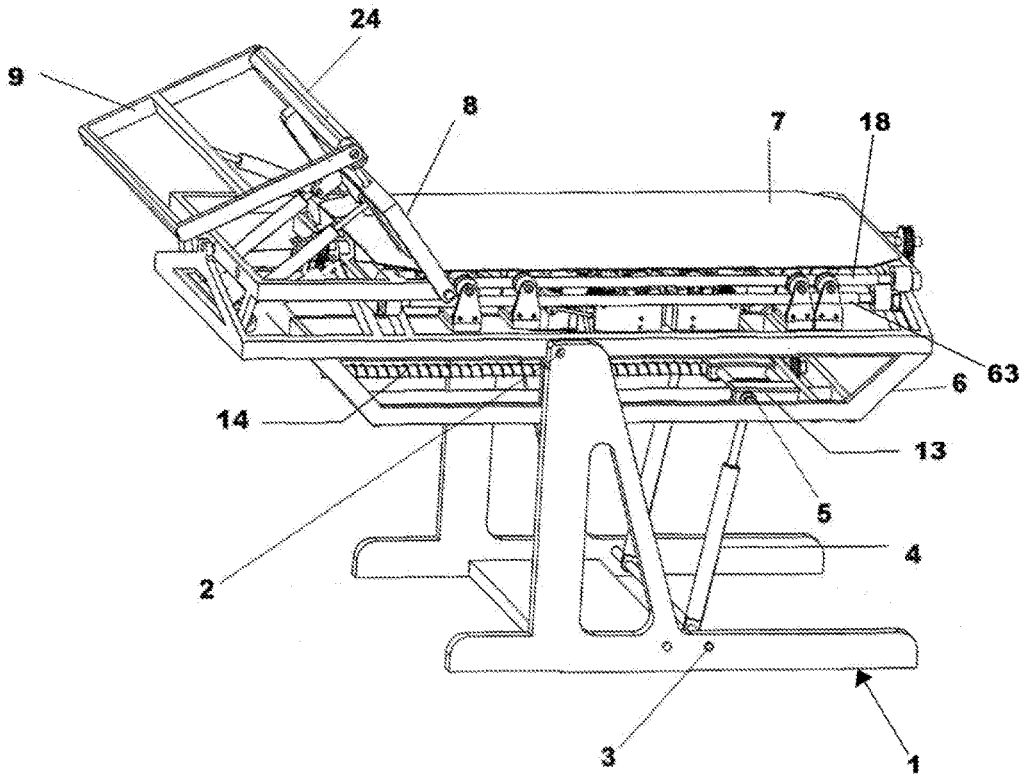
FIG. 54 is a top perspective view of the massage machine according to the invention similar to FIG. 4, with massage apparatus.

The massage apparatus is housed inside of the bed 6 as shown in FIG. 54, in which the other main parts are also illustrated, namely:

the base 1 including pivots 2, one on each side, for the connection to the bed, and a fixed transverse connecting bar 3 for hydraulic cylinders 4;

the bed 6 comprising adjustable transverse connecting bar 5 for the two hydraulic cylinders 4, which are part of the carriage 13, the worm screw 14 for the displacement of the carriage 13, the sitting plane 8 and the legs 9 being hinged on the adjustable spacer 24.

FIG. 55, in which the bed is horizontal, shows a stroke end position toward the head of the massage apparatus and the relative position of the various rollers below the patient supporting plane.

The importance of the pairs of series of idle transverse rollers 29 and 30 should be evident. Thanks to them, a continuity of support of the body of the patient is ensured even in absence of the roller systems.

Shown in FIG. 55 is also a headrest 67 with two scapular-humeral catching means 68, one for each shoulder, and leg locker device 69 comprising a pad 70 sustained by two height adjustable supports.

The headrest 67 is mechanically connected either to the head crossbar of the bed or at the sides of the bed and can slide axially to change its position according to the stature of the patient.

Changing the position of the headrest implies also changing limit stops of the massage apparatus.

The catching means 68 have the double task of accompanying the rotation of the patient's torso during the twisting and to limit excessive slipping backward during back tilting.

The leg locker device 69 has the task of blocking gently, without causing blood circulation problems, the patient's legs at the ankles.

The locking and opening of such a device is performed by a side hinge system 71, as seen in FIG. 56.

Figure 57:
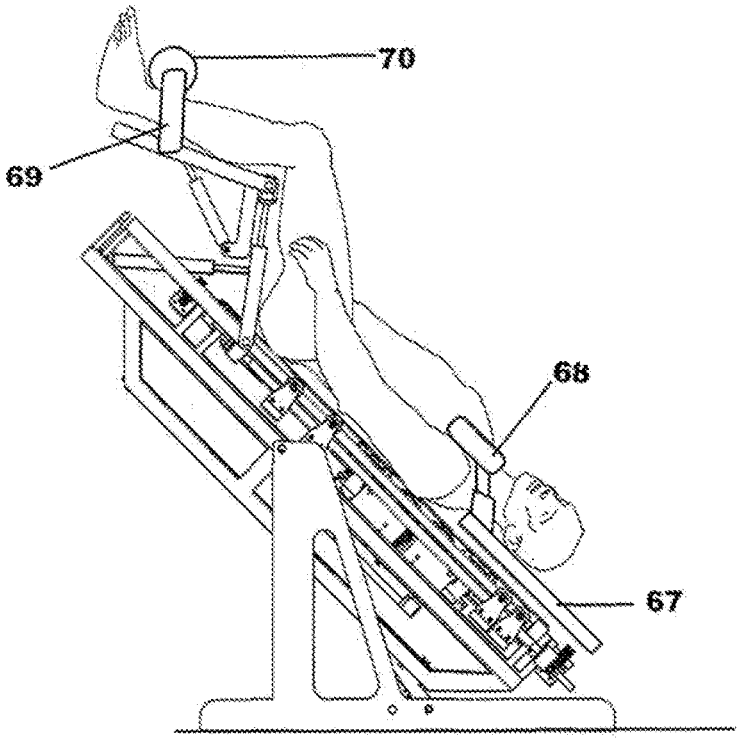

Shown in this same FIG. 56 is the bed in a vertical position for patient's entry and exit, and in FIG. 57 the same bed in 45 degrees back-tilted position. The horizontal position is already displayed in FIG. 55.

Figure 58:
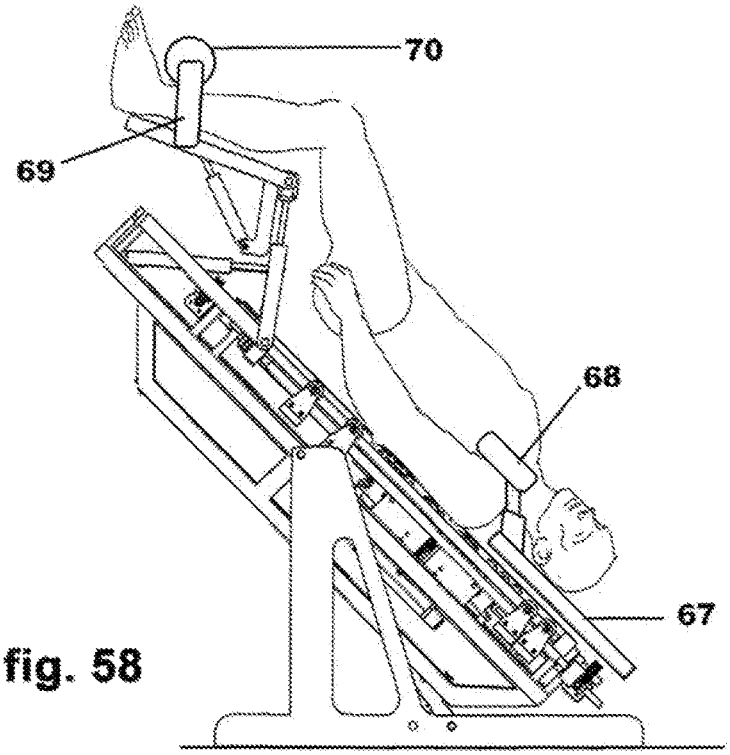
Figure 59:
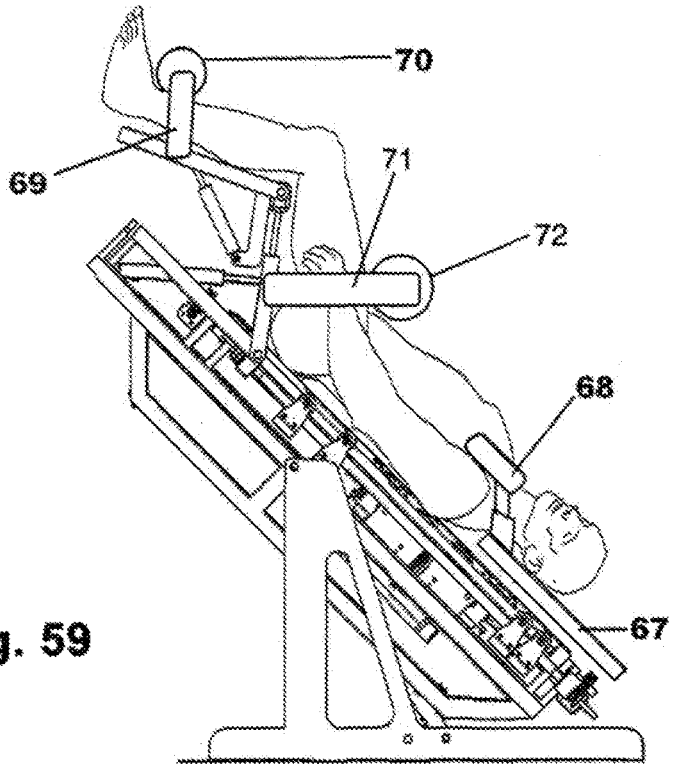

During the back-tilting a loss of contact between the patient's back and the patient supporting plane may occur, as shown in FIG. 58. A valid remedy is constituted by a roller retainer 72 being mounted on height adjustable supports 71 and positioned on the pelvic region, as shown in FIG. 59. The height may be adjusted so as to ensure the constant contact between the patient's back and the patient support plane without any compression in order to avoid any uncomfortable situation.

The invention claimed is:

1. A massage machine comprising a base (1) and a bed (6) having a first frame being mounted on horizontal pivots (2) of the base (1), said first frame of the bed (6) having a longitudinal axis and the horizontal pivots (2) being arranged at right angles to said longitudinal axis, said first frame of the bed (6) being able to be rotated about said horizontal pivots (2) by actuating means (4) pivoted in a fixed transverse connecting bar (3) of the base (1) and in an adjustable transverse connecting bar (5) that is shiftable in a direction parallel to the longitudinal axis of said first frame of the bed (6), the bed (6) being provided with a patient supporting plane (7), with a massage apparatus that is longitudinally movable under the patient supporting plane (7), and a patient supporting means, characterised in that the bed (6) comprises a second frame twistably mounted on the first frame about an axis parallel to the longitudinal axis of the first frame under the patient supporting plane (7), said second frame having pairs of lower and upper oscillating cross members (59, 60 and 59-A, 60-A) near the ends of the bed (6), the lower and upper oscillating cross members (59, 60 and 59-A, 60-A) being mutually joined by tie rods (61), the lower oscillating cross members being joined together by a pair of lower telescopic longitudinal members (62), the upper oscillating cross members being joined together by a pair of upper telescopic longitudinal members (63), the connection between the lower and upper oscillating cross members (59, 60 and 59-A, 60-A) and the lower and upper telescopic longitudinal members (62, 63) being made by means of ball joints (19-B); and said patient supporting plane (7) is arranged over said second frame and is limited by a head crossbar (17) and a foot crossbar (11), both said crossbars being pivotally mounted on the first frame of the bed (6) about an axis of rotation parallel to the longitudinal axis of the first frame, the head and foot crossbars (17, 11) being connected together by a pair of telescopic side members (18) by ball joints (19).

2. The massage machine according to claim 1, wherein the massage apparatus comprises massaging roller systems (27) and massaging planetary systems (28) both arranged on supporting frames (45, 45-A) in turn movable on said pair of lower telescopic longitudinal members (62) of said second frame.

3. The massage machine according to claim 2, wherein said patient supporting means comprises two pairs of series of idle transverse rollers (29, 30) slidably mounted on said pair of upper telescopic longitudinal members (63) by means of support elements (29-A, 30-A) each comprising an upper roller (29-B, 30-B) and two lower cylindrical rollers (29-C, 30-C), the one and the others being arranged in a triangle superiorly and inferiorly to the upper telescopic longitudinal members (63), each pair of series of transverse idle rollers (29, 30) being pantograph connected between the upper oscillating cross member (60, 60-A) of the second frame and the support frame (45, 45-A) of the massaging roller systems (27) and massaging planetary systems (28).

4. The massage machine according to claim 2, wherein the massaging roller systems (27) and the massaging planetary systems (28) are driven by a first geared motor (40) mounted on a gearbox (39) longitudinally sliding through threaded coupling with a threaded shaft (41-A) driven by a motor.

5. The massage machine according to claim 2, wherein each massaging planetary system (28) is mounted on supporting frames (45, 45-A) by a turntable rotated by means of actuators (38).

6. The massage machine according to claim 1, wherein a sitting plane (8) is pivotally mounted to the foot crossbar (11) in order to rotate about a sitting plane axis orthogonal to the axis of rotation of the head crossbar (17) and the foot crossbar (11), the sitting plane (8) being driven in rotation by means of actuators (26) being pivoted between the sitting plane (8) and the foot crossbar (11).

7. The massage machine according to claim 6, wherein the sitting plane (8) has a spacer (24) having an axis parallel to the sitting plane axis and being extendible to expand the surface of the sitting plane.

8. The massage machine according to claim 7, in which the sitting plane (8) is provided with legs (9) pivotally mounted to the spacer (24), the legs (9) being rotatable about said spacer axis by means of an actuator (25) being mounted to the spacer (24).

9. The massage machine according to claim 1, in which said adjustable transverse connecting bar (5) is mounted on a carriage (13) that slides along longitudinal guides (16) by the rotation of a worm screw (14) driven by a second geared motor (15), in order to move the point of application of the force that is exerted on the adjustable transverse connecting bar (5) by the pair of hydraulic cylinders (4), causing the first frame of the bed (6) to assume various positions ranging from a vertical position to a back-tilted position.

* * * * *